US007654060B2

(12) United States Patent
Steed et al.

(10) Patent No.: US 7,654,060 B2
(45) **Date of Patent: *Feb. 2, 2010**

(54) REINFORCED BLOW-MOLDED PLASTIC PANELS AND STRUCTURES

(75) Inventors: Brent Steed, Syracuse, UT (US); Jay Calkin, Ogden, UT (US); Kent Ashby, Logan, UT (US)

(73) Assignee: Lifetime Products, Inc., Clearfield, UT (US)

( * ) Notice: Subject to any disclaimer, the term of this patent is extended or adjusted under 35 U.S.C. 154(b) by 82 days.

This patent is subject to a terminal disclaimer.

(21) Appl. No.: 11/742,469

(22) Filed: Apr. 30, 2007

(65) Prior Publication Data

US 2007/0199253 A1 Aug. 30, 2007

Related U.S. Application Data

(63) Continuation of application No. 10/890,601, filed on Jul. 14, 2004, now Pat. No. 7,210,277, which is a continuation-in-part of application No. 29/180,861, filed on Apr. 30, 2003, now Pat. No. Des. 500,604, which is a continuation-in-part of application No. 29/180,870, filed on Apr. 30, 2003, now abandoned, said application No. 10/890,601 is a continuation-in-part of application No. 29/186,355, filed on Jul. 14, 2003, now abandoned.

(60) Provisional application No. 60/487,748, filed on Jul. 15, 2003.

(51) Int. Cl.
*E04C 2/00* (2006.01)

(52) U.S. Cl. ..... 52/782.1

(58) Field of Classification Search ..... 108/57.25, 108/132; 52/782.1, 239, 309.1, 309.7, 309.9, 52/787.1, 351, 135; 160/351, 135
See application file for complete search history.

(56) References Cited

U.S. PATENT DOCUMENTS

D139,766 S 12/1944 Bruner (Continued)

FOREIGN PATENT DOCUMENTS

JP 06226820 8/1994

(Continued)

OTHER PUBLICATIONS

International Search Report from PCT/US2004/022880, dated Jan. 11, 2006, 1 page.

(Continued)

*Primary Examiner*—José V Chen
(74) *Attorney, Agent, or Firm*—Workman Nydegger

(57) ABSTRACT

A partition system may include one or more panels. A panel may be constructed using blow-molded plastic. A panel may include one or more depressions, which may be aligned with one or more depressions on an opposing side of the panel. The depressions may provide additional structural integrity for a panel. The depressions on opposing sides of the panel may extend toward and engage each other. The panels may include patterns with which one or more depressions may intersect. The panels may include symmetric patterns on opposing sides. The partition system may include one or more connectors adapted to receive a portion of one or more panels. The partition system may include one or more feet that may be attached to one or more panels. The panels may include one or more reinforcing members of various shapes disposed proximate one or more edges of a panel.

40 Claims, 14 Drawing Sheets

U.S. PATENT DOCUMENTS

D202,177 S 9/1965 Blau et al.
3,220,151 A 11/1965 Goldman
3,401,494 A 9/1968 Anderson
3,700,213 A 10/1972 Blease
3,766,699 A 10/1973 Dinkel
3,778,949 A 12/1973 Hellerich
3,789,094 A 1/1974 Hutchison
3,905,167 A 9/1975 Watkins et al.
3,928,691 A 12/1975 Knudson
3,933,311 A 1/1976 Lemelson
4,010,586 A 3/1977 Brechbuhler
4,032,680 A 6/1977 Allard
D246,082 S 10/1977 Friedrich
4,110,951 A 9/1978 Padrun
4,128,369 A 12/1978 Kemerer et al.
4,175,883 A 11/1979 Lemelson
4,236,361 A 12/1980 Boden
4,290,248 A 9/1981 Kemerer et al.
4,313,385 A 2/1982 Fitzgerald
D278,395 S 4/1985 Keeler
4,609,192 A 9/1986 Bratcher
4,641,468 A 2/1987 Slater
4,674,250 A 6/1987 Altizer
D293,981 S 2/1988 Ball
4,972,634 A 11/1990 Dresden
5,106,915 A 4/1992 Rock et al.
5,255,803 A 10/1993 Pavone et al.
5,279,233 A 1/1994 Cox
5,293,720 A 3/1994 Brice et al.
5,358,423 A 10/1994 Burkhard et al.
5,405,670 A 4/1995 Wetzel et al.
5,528,997 A 6/1996 Miller
5,544,870 A 8/1996 Kelley et al.
D376,622 S 12/1996 Roberts
5,609,327 A 3/1997 Amidon
5,626,331 A 5/1997 Erwin
5,640,816 A 6/1997 Reiland et al.
5,657,583 A 8/1997 Tennant
5,660,907 A 8/1997 Skalka
5,671,913 A 9/1997 Vesper
5,715,854 A 2/1998 Andrieux et al.
5,791,262 A * 8/1998 Knight et al. ..... 108/57.25
D397,562 S 9/1998 DePottey et al.
5,807,618 A 9/1998 Shiota et al.
D400,737 S 11/1998 DePottey et al.
5,845,588 A * 12/1998 Gronnevik ..... 108/57.27
5,868,080 A * 2/1999 Wyler et al. ..... 108/57.25
5,868,630 A 2/1999 Saksun, Jr.
5,890,607 A 4/1999 Maglione
5,911,932 A 6/1999 Dyksterhouse
5,915,724 A 6/1999 Daris et al.
5,961,100 A 10/1999 Lechtenboehmer
6,060,144 A 5/2000 Kimura et al.
6,101,967 A 8/2000 Glass et al.
6,109,687 A 8/2000 Nye et al.
6,112,674 A * 9/2000 Stanford ..... 108/132
6,185,878 B1 2/2001 Bullard, III et al.
6,189,270 B1 2/2001 Jeffers et al.
6,193,083 B1 2/2001 Wood
6,250,022 B1 6/2001 Paz et al.
6,250,234 B1 * 6/2001 Apps ..... 108/57.25
6,257,559 B1 7/2001 Mouri
6,311,956 B1 11/2001 Erwin
6,363,680 B1 4/2002 Erwin
6,374,756 B1 4/2002 Fieldwick et al.
6,385,942 B1 5/2002 Grossman et al.
6,443,521 B1 9/2002 Nye et al.
6,446,414 B1 9/2002 Bullard et al.
6,524,518 B1 2/2003 Pelfrey
6,524,690 B1 2/2003 Dyksterhouse
6,571,529 B2 6/2003 Knudson et al.
6,591,558 B1 7/2003 De Zen
6,622,642 B2 * 9/2003 Ohanesian ..... 108/57.25
6,631,821 B2 10/2003 Vourganas
6,637,728 B2 10/2003 Pettit et al.
6,646,022 B2 11/2003 Okazaki et al.
6,656,316 B1 12/2003 Dyksterhouse
6,666,152 B2 12/2003 Tsai
6,670,419 B2 12/2003 Lau et al.
6,694,897 B2 * 2/2004 Lou-Hao ..... 108/132
6,695,544 B2 2/2004 Knudson et al.
6,705,796 B2 3/2004 Lund
6,709,995 B1 3/2004 Dyksterhouse
6,718,888 B2 * 4/2004 Muirhead ..... 108/57.25
6,726,864 B2 4/2004 Nasr et al.
6,748,876 B2 * 6/2004 Preisler et al. ..... 108/57.25
6,752,278 B2 6/2004 Craft et al.
D500,604 S 1/2005 Ashby
6,971,321 B1 * 12/2005 Strong et al. ..... 108/133
6,976,437 B2 * 12/2005 Fisch et al. ..... 108/57.25
7,069,865 B2 7/2006 Strong et al.
7,165,499 B2 * 1/2007 Apps et al. ..... 108/57.25
7,210,277 B2 * 5/2007 Steed et al. ..... 52/782.1
7,308,857 B2 * 12/2007 Moore et al. ..... 108/51.11
2001/0009703 A1 7/2001 Toshikawa
2002/0000545 A1 1/2002 Pettit et al.
2002/0088560 A1 7/2002 Amin-Javaheri
2003/0146426 A1 8/2003 Ray et al.
2003/0197165 A1 10/2003 Perelli
2003/0201272 A1 10/2003 Carter

FOREIGN PATENT DOCUMENTS

JP 07-012123 2/1995
JP 08108464 4/1996

OTHER PUBLICATIONS

International Preliminary Report on Patentability, from PCT/US2004/022880, dated Mar. 21, 2006, 6 pages.

* cited by examiner 36
56
54
38
100
98
2
86
90
92
88
4
6
16
12
32
34
10
8
40
14
42
60
58
44
70
84
72
74
76
78
80
82
100
2
88

30
102
100
50
62
64
52
2
100
2
96
92
54
26
56
28
58
94
88
92
20
18
46
48
24
22
68
66

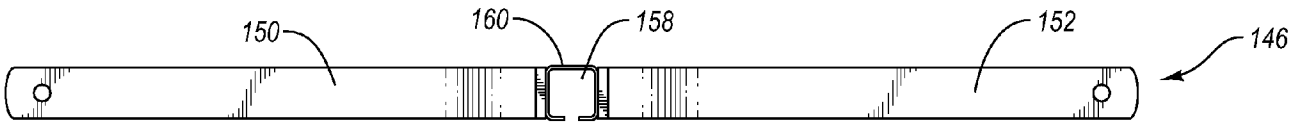
Fig. 14
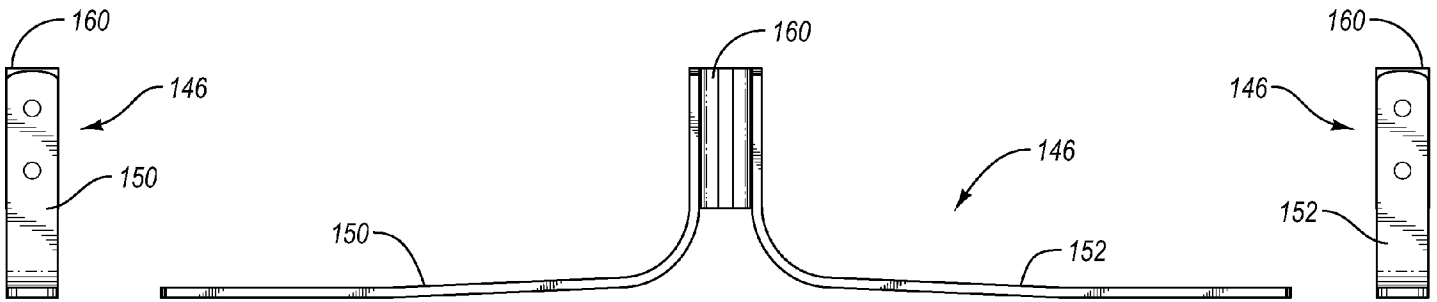
Fig. 15B
Fig. 12
Fig. 15A
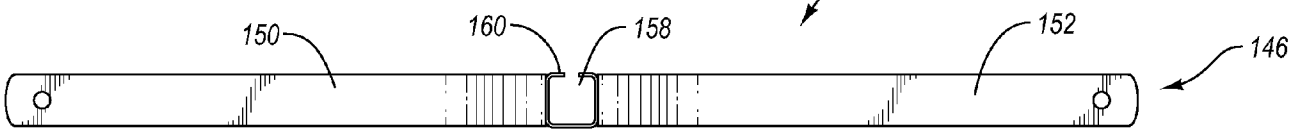
Fig. 13

REINFORCED BLOW-MOLDED PLASTIC PANELS AND STRUCTURES

CROSS-REFERENCE TO RELATED APPLICATIONS

This application is a continuation of U.S. patent application Ser. No. 10/890,601, entitled PARTITION SYSTEM, which was filed on Jul. 14, 2004, now U.S. Pat. No. 7,210,277.

U.S. patent application Ser. No. 10/890,601 claims priority to and the benefit of U.S. Provisional Patent Application Ser. No. 60/487,748, entitled PARTITION SYSTEM, which was filed on Jul. 15, 2003, and this application is a continuation-in-part of U.S. Design patent application Ser. No. 29/180,861, entitled PARTITION CONSTRUCTED FROM BLOW-MOLDED PLASTIC, which was filed on Apr. 30, 2003, now U.S. Pat. No. D500,604; a continuation-in-part of U.S. Design patent application Ser. No. 29/180,870, entitled CLIP FOR CONNECTING ONE OR MORE PARTITIONS, which was filed on Apr. 30, 2003, now abandoned; and a continuation-in-part of U.S. Design patent application Ser. No. 29/186,355, entitled SUPPORT FOR A PARTITION, which was filed on Jul. 14, 2003, now abandoned.

Each of these patents and applications are incorporated by reference in their entireties.

BACKGROUND OF THE INVENTION

1. Field of the Invention

The present invention generally relates to a partition system and, in particular, to a petition system that may include a plurality of panels or partitions that can be interconnected into a variety of configurations and arrangements.

2. Description of Related Art

It is known to use panels or panel systems to construct a variety of structures such as building partitions, utility sheds, tool sheds, furniture and containers. These known systems typically include one or more connectors that allow one or more panels to be connected.

A known type of connector that is used to connect two panels together are connector members that have a generally I-beam type configuration. In particular, these known connector members may have a generally I-shaped cross-section and each side of the I-beam type connector may be sized and configured to be attached to a panel. For example, one side of the I-beam type connector may form an edge portion that fits within slots in one of the panels. Thus, the sides of the I-beam type connector members may engage the edges of the panels to allow one or more of the panels to be connected. These types of conventional connector members allow the panels to be joined at a right angle or in a straight line.

Disadvantageously, these conventional I-beam type connector members are often elongated members that are difficult to attach to the panels. These elongated connector members are also relatively heavy, difficult to use and difficult to position in the desired locations. It is also known to use other types of connectors to interconnect one or more panels. These connectors, however, often include a number of parts and are complicated to use. In addition, many conventional connectors are constructed from metal, which is heavy and may include sharp edges. These metal connectors, which are typically exposed to the elements, may rust, deteriorate or otherwise weaken over time. Further, these metal components are often bent, twisted, or otherwise deformed from the desired configuration. For example, these metal components may be bent, twisted or deformed during shipping, assembly or use.

The panels used in connection with these known panels systems are made from a wide variety of materials. For example, known panels have been constructed from metal and all or a portion of the panels may be covered with fabric or other types of suitable materials. Disadvantageously, these panels are often heavy, difficult to move and ship, expensive to manufacture, and the panels generally require finishing such as sanding and/or painting.

It is also known to construct panels from materials such as plastic. The plastic panels, however, are often not sufficiently rigid and the panels often create a flimsy structure because the panels do not have adequate structural integrity. The plastic panels may also be difficult to securely interconnect and the plastic panels may buckle or crack.

Disadvantageously, the opposing sides of conventional plastic panels may be different. For example, the design on one side of the panel may be different from the design on the other side of the panel. Thus, the panels are not truly interchangeable because the sides of the panels must be arranged in a particular relationship. For instance, one side of the panels may include various recesses and indentations caused during the manufacturing process. This may create a panel that has a generally smooth surface on one side and an opposing side that includes a number of bumps and bulges. The opposing sides of the panels may also include one or more beams or other similar structures that are designed to increase the strength of the panels. Significantly, the different opposing sides of the panels may limit the usefulness of the panels. In particular, only one side of the panel may be aesthetically pleasing and it may be desirable to hide the other side from view. Accordingly, because conventional panels constructed from plastic often include opposing sides that have different configurations, the usefulness of the panels may be limited. In addition, one or more sides of conventional plastic panels often include imperfections or other types of visual defects that are created during the manufacturing process. This may also limit the usefulness of the panels.

These known plastic panels may be constructed or formed into the desired shapes and sizes using a blow-molding process. As known to those skilled in the art, blow-molded plastic structures often include an outer wall that encloses a hollow interior space. Conventional panels constructed from blow-molded plastic, however, are typically not high-strength components because, for example, of the hollow interior space. In fact, conventional blow-molded panels are often relatively low-strength, which may allow the panels to buckle or fail.

In order to increase the strength of conventional blow-molded structures, it is known to form structures with integral plastic ribs or beams. These ribs are generally large, elongated portions that require thicker outer walls so that the ribs are correctly formed in the structure. Disadvantageously, the thicker outer walls of the ribs require additional plastic materials be used to create the structure, which increases costs and weight. In addition, the thicker outer walls retain more heat during the manufacturing process. Thus, a longer cooling time is required during the manufacturing process in order to allow the thicker outer walls to cool. This undesirably increases the time of the manufacturing process because blow-molded structures cannot be removed from the mold until the structures are sufficiently cooled.

While the large strengthening ribs may be designed to prevent large portions of the blow-molded plastic structures from sagging, the ribs may allow smaller, localized portions of the structure to bend or sag. Additionally, because many strengthening ribs are large and have an elongated length, the ribs may support localized portions of the structure differently than the other portions of the structure. Thus, the opposing surfaces of conventional blow-molded structures may be uneven because different portions of the structures are supported differently.

BRIEF SUMMARY OF THE INVENTION

A need therefore exists for a partition system that eliminates the above-described disadvantages and problems.

One aspect is a partition system that may be used in a wide variety of environments and configurations. For example, the partition system can be used to create various types, sizes, configurations and arrangements of a wide variety of structures such as walls, divides, barriers and the like. The partition systems can also be used to create various types of enclosures such as workstations, offices, cubicles and the like. Advantageously, the partition system may be part of a prefabricated and/or modular system that can be arranged and configured into a variety of suitable arrangements and layouts.

Another aspect is a partition system that may include one or more components and the components are preferably interchangeable. Significantly, this may allow the partition system to be rapidly assembled and easily changed. This may also allow the partition system to create structures that are temporary or permanent. Significantly, these structures can be free-standing and independent from other structures, or the structures can be attached or secured to one or more other structures. In addition, while a frame may be used to connect and/or assembly the partition system, a frame is not required.

Still another aspect is a partition system that may include one or more panels that may have various sizes and configurations. For example, the panels may be sized and configured to construct workstations or office cubicles. Thus, the panels may be five or six feet in height and two or three feet in width to allow workstations or office cubicles to be easily constructed. The panels, however, may have any desired size and configuration depending, for example, upon the intended use of the panels. In addition, while the panels are preferably rectangular in configuration, the panels may be square, curved, rounded or have other suitable shapes depending upon the intended use of the partitions.

Yet another aspect is a partition system that may include one or more partitions that are constructed from plastic. In particular, the partitions are desirably constructed from blow-molded plastic which includes two opposing surfaces in a hollow interior portion. The opposing surfaces are preferably separated by a generally constant distance, but the distance between the surfaces may also vary. Advantageously, panels constructed from blow-molded plastic may be lightweight, durable, rust-resistant and generally weather resistant.

A further aspect is a partition system that may include one or more panels or partitions and the opposing sides of the partitions may have the same pattern. For example, the opposing sides of the panels preferably may have a grid, lattice, network or pattern that is the same on both sides. Thus, the panels may be reversible and interchangeable.

Still another aspect is a partition system that may include one or more panels or partitions and the panels or partitions may have patterns on each side. In particular, the partitions may have patterns on both sides of the partitions and the patterns may contain one or more depressions that extend towards or engage an opposing surface. Preferably, the patterns on both sides of the partitions include one or more depressions and the depressions are generally aligned so that a depression on one side of a panel is aligned with a depression on the other side of the panel. The depressions are preferably integrally formed in the panels and the depressions may be sized and configured to increase the strength of the panels. Desirably, the depressions are positioned on opposing sides of the panels and the depressions are sized and configured to engage or abut proximate the center of the panel. Advantageously, because the depressions are formed on both sides of the panel, the opposing sides of the panel may have generally the same pattern. This allows a panel with the same design on opposing sides of the panel to be created.

Advantageously, the depressions formed on both sides of the panel can be closely spaced, which increases the number of depressions that can be formed in the panels. The increased number of depressions formed in the blow-molded panel at first appears to increase the amount of plastic material required to construct the structure because of the increased surface area and number of depressions. The increased number of depressions with the increased amount of plastic would also appear to increase the time the panels must be cooled during the manufacturing process. In particular, it would appear that the panels would require an increased amount of plastic, which would retain more heat and require a longer cooling time before the panels could be removed from the mold. This would increase the cycle time required to construct the panels because the panels could not be removed as quickly from the mold. The increased number of depressions and closer spacing of the depressions, however, allows the outer wall of the panels to be constructed from thinner plastic. Thus, contrary to conventional blow-molded structures, increasing the number of depressions allows blow-molded panels with thinner walls to be constructed.

Significantly, the increased number of depressions and thinner outer walls allow less plastic to be used to construct the blow-molded panels. The reduced amount of plastic advantageously saves materials and resources. In addition, the costs of the blow-molded panels may be decreased because less plastic is required. In addition, the increased number of depressions and thinner outer walls results in less materials being used to construct the panels, which reduces the weight of the panels. Thus, lightweight blow-molded panels can be constructed.

A still further aspect is a partition system that may include one or more panels or partitions. The panels may be constructed from blow-molded plastic and the panels may have thin outer walls that allow heat to be quickly dissipated during the manufacturing process. Because the thinner outer walls allow heat to be dissipated more quickly, the blow-molded panels may cool more quickly in the mold. This may allow the panels to be removed more quickly from the mold. Additionally, because the increased number of depressions provides more support for the opposing surfaces, the panels may be removed from the mold at a higher temperature. Accordingly, the manufacturing time and/or cycle time required to construct the blow-molded panels may be reduced, which may increase the output and/or efficiency of the blow-molding process.

Yet another aspect is a partition system that may include one or more panels or partitions. The panels may be constructed from blow-molded plastic and the reinforcing ribs and/or beams that are typically formed in blow-molded plastic panels are not required. In fact, reinforcing ribs or beams are desirably not formed in the blow-molded panels because reinforcing ribs require thicker outer walls, which increases the time of the manufacturing process and prevents the panels from having the same design on the opposing sides.

A further aspect is a partition system that may include one or more panels or partitions. The panels may be constructed from blow-molded plastic and the panels may include one or more depressions that are formed in one surface and extend towards an opposing surface. The depressions are preferably uniformly spaced to create a generally consistent and/or standardized arrangement of depressions. A consistent arrangement of the depressions may help create panels with uniform characteristics. For example, a generally constant pattern of depressions may create panels with generally uniform strength and structural integrity. Accordingly, the depressions in the panels may be formed in a generally uniform pattern such as a grid or lattice. Significantly, the same grid or lattice may be formed on both sides of the panels.

Another aspect is a partition system that may include one or more panels or partitions: The panels may be constructed from blow-molded plastic and the blow-molded panels may have a lower profile because reinforcing ribs are not required. Thus, the height or thickness of the blow-molded panels may be decreased. As discussed above, conventional reinforcing ribs may also create uneven surfaces in the opposing surface because the opposing surface may not be supported evenly. In addition, the distance separating the opposing surfaces may vary because of the reinforcing ribs. Advantageously, the closely spaced depressions allow large panels to be created that do not include significant sags, ripples or uneven surfaces.

Still another aspect is a partition system that may include one or more panels or partitions. The panels may be constructed from blow-molded plastic and the panels may include one or more hollow portions. For example, the panels may include a generally hollow core or center portion. The hollow and/or center portions of the panels, however, may be filled with materials such as foam or other materials. The foam may be designed to increase the strength of the panels or may be intended to provide heat and/or sound insulation. The foam or other materials used to fill the interior portion of the panels is preferably lightweight so that the panels are lightweight. The foam or other materials may also have other suitable properties and characteristics.

Yet another aspect is a partition system that may include one or more panels or partitions. One or more of the panels may have an edge or border on at least one of the sides of the panels. The borders may be designed to provide increased protection and/or strength of the panels. The borders may also include a slot, groove or other type of channel. Desirably, at least two sides of the panels include borders and, if desired, all sides of the panels may include borders but borders are not required.

A further aspect is a partition system that may include one or more panels or partitions. The partition system may also include one or more connectors that are sized and configured to connect one or more of the partitions. Advantageously, the connectors may allow the partitions to be connected in a variety of suitable configurations. For example, the connectors may allow the partitions to be joined in a linear or a straight line configuration, or at a right angle or at any other desired angle. Significnatly, the connectors may allow for the simple, straight-forward connection of two or more partitions. Desirably, tools are not required to connect the partitions and the partitions are securely connected by the connectors. The connectors are preferably sized and configured to engage the borders to allow the partitions to be interconnected. In particular, the connectors preferably have engaging portions that are sized and configured to be inserted into one or more grooves forming a portion of the borders.

Yet another aspect is a partition system that may include one or more panels or partitions. The partition system may also include one or may feet which may be used to support the partitions in a generally vertical or upright configuration. The feet may also be used to connect two or more partitions. Further, the feet may be used to support the partitions in any desired angle or configuration.

A further aspect is a partition system that may include one or more panels or partitions that may be selectively or permanently connected. Desirably, the partition system has few components and the components are preferably interchangeable. This may allow the components to be arranged into a customized arrangement. Additionally, the components are preferably connected without tools, which may allow the system to be shipped in an unassembled configuration and then the customer can easily assemble the system into the desired arrangement. This may also allow the customer to configure the partition system into any suitable arrangement or design.

Another aspect is a partition system that may include one or more panels or partitions. One or more of the panels may include one or more reinforcing members, which may be used to strengthen and/or increase the rigidity of the panels. In addition, the reinforcing members may provide additional structural integrity for one or more portions of the panel. The panels may also include two or more reinforcing members if desired. While the reinforcing members may be located proximate at least a portion of an edge of a panel, the reinforcing members may be located in any desired portion of the panel.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages, and features of the present invention. It will be appreciated that these drawings depict only preferred embodiments of the invention and are not intended to limit its scope. The invention will be described and explained with additional specificity and detail through the use of the accompanying drawings in which:

FIG. 12 is a front view of the foot shown in FIG. 10;

FIG. 13 is a bottom view of the foot shown in FIG. 10;

FIG. 14 is a top view of the foot shown in FIG. 10;

FIG. 15A is a left side view of the foot shown in FIG. 10;

FIG. 15B is a right side view of the foot shown in FIG. 10;

DETAILED DESCRIPTION OF THE PREFERRED EMBODIMENTS

The present invention is directed towards a partition system. The principles of the present invention, however, are not limited to a partition system. It will be understood that, in light of the present disclosure, the partition system disclosed herein can be successfully used in connection with other types of systems, devices, structures and the like.

Additionally, to assist in the description of the partition system, words such as top, bottom, front, rear, right and left are used to describe the accompanying figures. It will be appreciated, however, that the partition system can be located in a variety of desired positions—including various angles, sideways and even upside down. A detailed description of the partition system now follows.

Figures 1A, 2A:
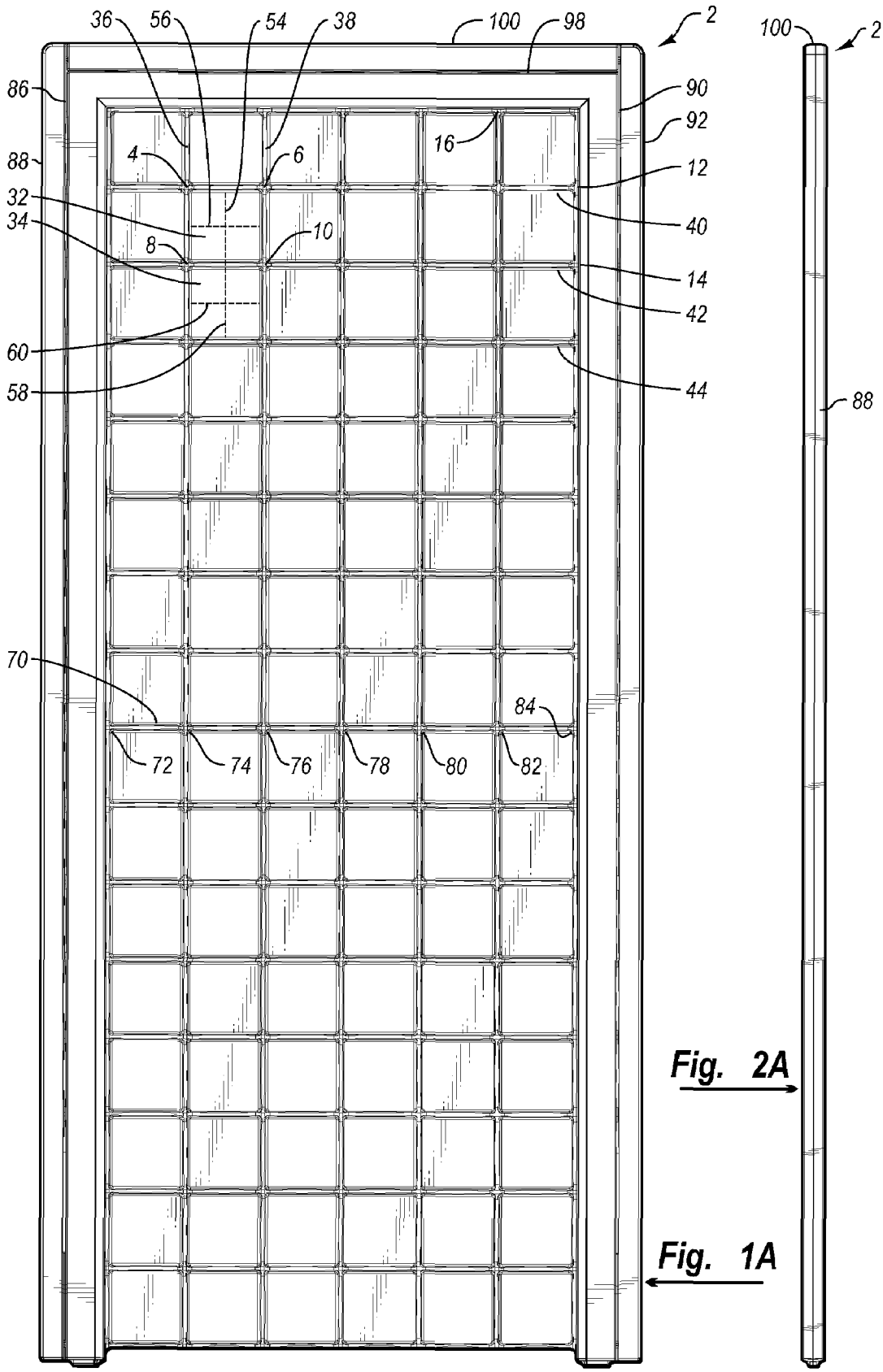
FIG. 1A is a front view of an exemplary embodiment of a panel or partition that may be constructed from blow-molded plastic and used in connection with a partition system.
FIG. 2A is a left side view of the panel or partition shown in FIG. 1.

As shown FIG. 1A, the partition system may include one or more panels or partitions 2, such as shown in the accompanying figures. As discussed in greater detail below, one or more of the panels 2 may be used to create a variety of structures, such as, walls, dividers, fences, gates, doors, barriers, workstations, cubicles, offices, children's playhouses and/or jungle gyms, picnic tables, furniture, shelves, tool sheds, utility sheds, dog houses, containers, or the like. In fact, one or a plurality of panels may be used for any of a variety of other suitable uses and systems.

The panel 2 may preferably be constructed from a moldable and/or formable material, such as, plastic or the like. In particular, the panel 2 may be constructed from high-density polyethylene, but other suitable types of plastics may also be used. The panel 2 may be constructed by a blow-molding process, but the panel 2 could be constructed by vacuum-molding, injection-molding, extrusion-molding, or any other suitable process. In one embodiment, the panel 2 may be constructed by attaching two sides together; the two sides being formed using vacuum-molding, injection-molding, extrusion-molding, or any other suitable process. In one embodiment, the panel 2 may be constructed by as a unitary, one-piece structure using, for example, blow-molding or another suitable process. Advantageously, a panel constructed from blow-molded plastic is generally light-weight, strong, durable, rust-resistant, and weather-resistant. For example, a structure designed for outdoor use (such as, a utility shed, a fence, a picnic table, a dog house, or the like) may advantageously resist damage commonly resulting from such use. Further, a panel constructed from blow-molded plastic may also be formed into any of a variety of desired shapes, sizes, colors, designs, configurations, and the like. Of course, the panel 2 need not be constructed using plastic or blow-molded plastic. Indeed, the panel 2 may be constructed from any other suitable material having other appropriate characteristics, including, but not limited to, wood, metals, or the like. Further, two or more different panels 2 (such as, panels constructed using different materials and/or having different characteristics) may be used with each other, depending on the intended purpose.

In one embodiment, the panel 2 may be prefabricated. One or more panels 2 may be connected in a wide variety of configurations, arrangements, and layouts. Advantageously, one or more panels 2 and/or other portions of the partition system described herein may be interchangeable to allow various permanent and/or temporary structures to be constructed. Significantly, one or more panels 2 may be part of a modular system that can be formed into a freestanding or independent structure. It will be understood that the panels may also be connected to other structures and supports as desired.

In one embodiment, the panel 2 may have a generally rectangular configuration with a length and a width. In particular, the panel 2 may have a height of about six feet and a width of about two to about three feet, which may be used to construct offices, cubicles, or other suitable structures. Of course, the panel 2 may be larger or smaller depending, for example, upon the intended use of the panel 2. Although the panel 2 may be generally rectangular, the panel 2 may be generally square, circular, polygonal, irregularly-shaped, or may have any other desired shape or design.

Figures 1B, 2B:
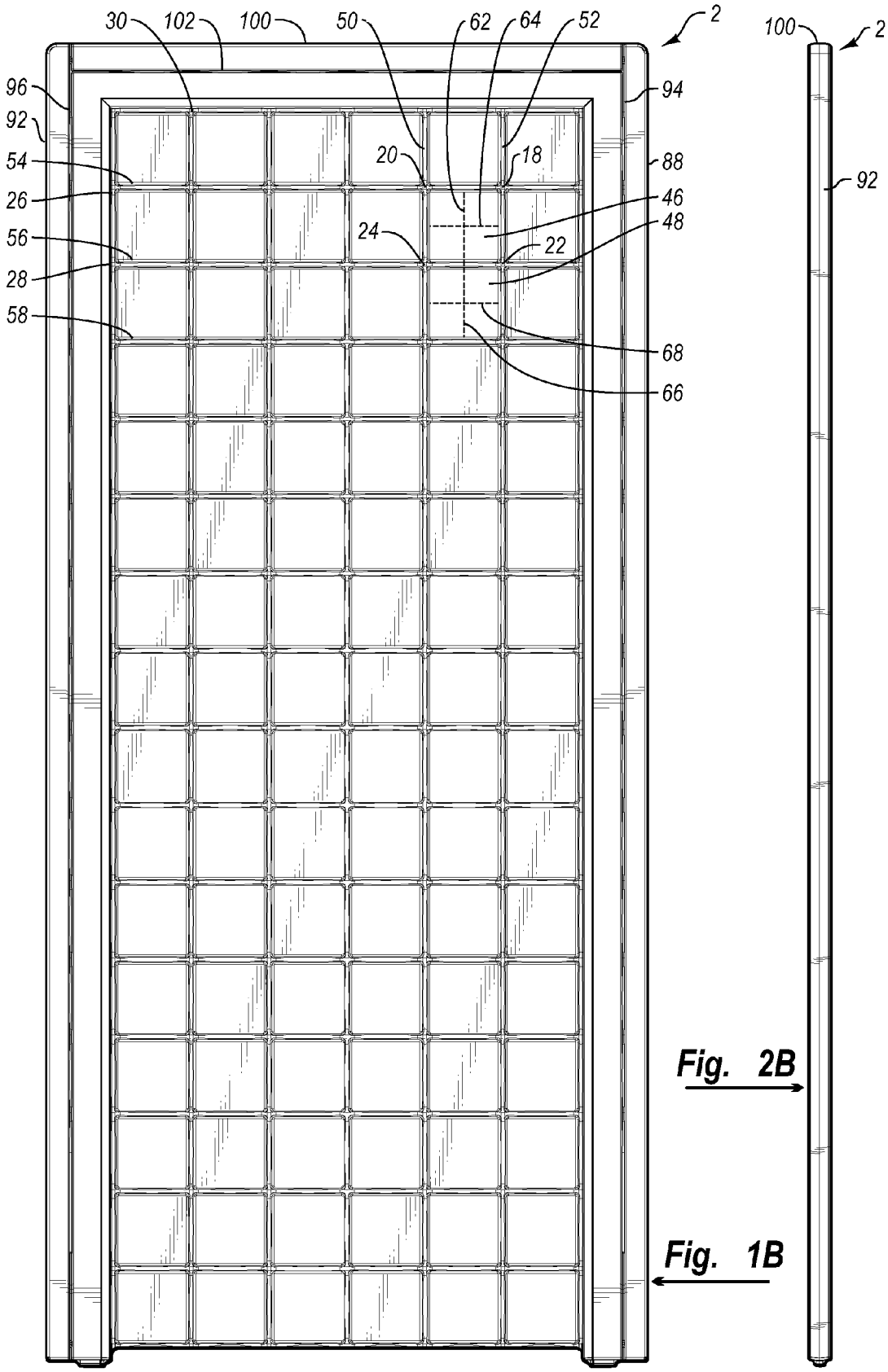
FIG. 1B is a rear view of the panel or partition shown in FIG. 1.
FIG. 2B is a right side view of the panel or partition shown in FIG. 1.

The panel 2 may have a pattern one or more sides of the panel 2. For example, FIG. 1A illustrates that the panel 2 may have a pattern shown from a front view. Desirably, the panel 2 also has a pattern on the opposing side of the panel 2. For example, FIG. 1B is a rear view of the panel 2 (FIG. 1A), which illustrates a pattern formed on the opposing side of the panel 2. As shown in FIGS. 1A and 1B, the panel may have the same pattern on both sides of the panel 2. Advantageously, with the same pattern on both sides of the panel 2, a symmetrical panel may be created, which may be reversible and interchangeable. With the same pattern on each side and/or with a symmetrical pattern, a symmetrical panel may have more potential uses. Of course, the panel 2 may only have a pattern on one side. Also, the panel 2 may have different patterns (including but not limited to asymmetrical patterns) on different sides. Further, the sides of the panel 2 do not require any particular pattern and do not require any pattern at all.

In one embodiment, the panel 2 may have one or more sides that include a pattern, such as, a grid; a network; a network of horizontal and vertical lines; a network of perpendicular lines; a lattice; a crisscross pattern; a pattern of regularly spaced horizontal and vertical lines forming squares; a pattern of regularly spaced horizontal and vertical lines forming rectangles; an arrangement of design elements in a regular, periodic pattern; or the like. The opposing sides of the panel 2 may include patterns that are generally aligned, such as, along one or more generally straight lines; along one or more generally horizontal lines; along one or more generally vertical lines; any combination thereof; or in any other suitable alignment. Of course, the sides of the panel 2 do not require patterns that are aligned.

In one embodiment, the panel 2 may have one or more sides that include a pattern formed with one or more depressions or "tack-offs," which may advantageously be disposed within a pattern. For example, the panel 2 may include one or more depressions, such as depressions 4, 6, 8, 10, 12, 14, and 16 (FIG. 1A) and depressions 18, 20, 22, 24, 26, 28, and 30 (FIG. 1B). The depressions may extend towards an opposing surface of the panel 2. Some or all of the surfaces of the panel 2 may be generally flat or may other suitable configurations. Opposing surfaces of the panel 2 may be generally parallel with respect to each other or may have any other suitable relationship. The depressions may be disposed proximate an opposing surface of the panel 2 and may engage an opposing surface of the panel 2. The depressions need not be disposed proximate an opposing surface or engage an opposing surface of the panel 2. In one embodiment, the pattern formed with one or more depressions may allow the depressions to be closely spaced. The one or more depressions may increase the strength, rigidity, or both strength and rigidity of the panel 2. The depressions may be spaced in other suitable manner and/or relative locations. Further, the panel 2 does not require depressions to be within a pattern and does not require depressions at all.

A side of the panel 2 may include a pattern include any suitable shape, configuration, or design. In one embodiment, as shown in FIG. 1A, the pattern may define one or more shaped portions, such as, shaped portions 32 and 34. The shaped portion 32, the shaped portion 34, or both may include a generally square, generally flat surface defined by lines 36, 38, 40, 42, and 44. The lines 36, 38 may be generally vertically oriented (as viewed from the perspective shown in FIG. 1A) and may be generally straight. The lines 40, 42, and 44 may be generally horizontally oriented (as viewed from the perspective shown in FIG. 1A) and may be generally straight. Thus, some or all of the lines 36 and 38 may be disposed in a generally perpendicular manner with respect to some or all of the lines 40, 42, and 44. Similarly, as shown in FIG. 1B, the shaped portion 46, the shaped portion 48, or both may include a generally square, generally flat surface defined by lines 50, 52, 54, 56, and 58. The lines 50, 52 may be generally vertically oriented (as viewed from the perspective shown in FIG. 1B) and may be generally straight. The lines 54, 56, and 58 may be generally horizontally oriented (as viewed from the perspective shown in FIG. 1B) and may be generally straight. Thus, some or all of the lines 50 and 52 may be disposed in a generally perpendicular manner with respect to some or all of the lines 54, 56, and 58. Of course, a side of the panel 2 does not require any lines (such as, the lines 36, 38, 40, 42, 44, 50, 52, 54, 56, and 58) at all and does not require that any lines be generally horizontal, generally vertical, generally straight, or in any particular orientation with respect to each other. Indeed, one or more lines may form any suitable shape or design, including, but not limited to, a square, a circle, an oval, an ellipse, a polygon, an irregularly-shaped figure, a symmetrically shaped figure, an asymmetrically shaped figure, or any other desired shape, configuration, or design. Accordingly, a shaped portion need not include a generally square shape or a generally flat surface. In fact, a shaped portion may be generally square, circular, oval, elliptical, polygonal, irregularly-shaped, symmetrically shaped, asymmetrically shaped, or any other desired shape, configuration, or design—depending upon, for example, the intended purpose of the shaped portion. Further, a side of the panel 2 does not require a shaped portion.

In one embodiment, a line (such as, the lines 36, 38, 40, 42, 44, 50, 52, 54, 56, and 58) may comprise one or more channels or grooves that may be disposed toward an opposing surface of the panel 2 and that may be spaced apart from the surface of a shaped portion (such as, shaped portions 32, 34, 46, and 48). Preferably, at least a portion of a channel or groove does not engage an opposing surface of the panel 2; however, some or all of a channel or groove may engage an opposing surface of the panel 2, depending upon, for example, the intended purpose of the channel or groove. In one embodiment, a line may comprise one or more lips or ridges that may be disposed away from an opposing surface of the panel 2 and that may be spaced apart from the surface of a shaped portion. Preferably, at least a portion of a lip or ridge does not engage an opposing surface of the panel 2; however, some or all of a lip or ridge may engage an opposing surface of the panel 2, depending upon, for example, the intended purpose of the lip or ridge. Of course, a side of the panel 2 does not require lines (including channels, grooves, lips, and ridges), which are optional.

In one embodiment, a shaped portion may include one or more generally central axes. The shaped portion may have a generally horizontal axis, a generally vertical axis, or both. For example, as illustrated in FIG. 1A, the shaped portion 32 may include a generally vertical axis (as indicated by the dotted line 54) disposed generally toward the center of the width of shaped portion 32 and may include a generally horizontal axis (as indicated by the dotted line 56) disposed generally toward the center of the height of shaped portion 32; and the shaped portion 34 may include a generally vertical axis (as indicated by the dotted line 58) disposed generally toward the center of the width of shaped portion 34 and may include a generally horizontal axis (as indicated by the dotted line 60) disposed generally toward the center of the height of shaped portion 34. Thus, some or all of the lines 36 and 38 may be disposed generally parallel to some or all of the axes 54 and 58 and may be disposed in a generally perpendicular manner with respect to some or all of the axes 56 and 60. Also, some or all of the lines 40, 42, and 44 may be disposed generally parallel to some or all of the axes 56 and 60 and may be disposed in a generally perpendicular manner with respect to some or all of the axes 54 and 58. Also as an example, as illustrated in FIG. 1B, the shaped portion 46 may include a generally vertical axis (as indicated by the dotted line 62) disposed generally toward the center of the width of shaped portion 46 and may include a generally horizontal axis (as indicated by the dotted line 64) disposed generally toward the center of the height of shaped portion 46; and the shaped portion 48 may include a generally vertical axis (as indicated by the dotted line 66) disposed generally toward the center of the width of shaped portion 48 and may include a generally horizontal axis (as indicated by the dotted line 68) disposed generally toward the center of the height of shaped portion 48. Thus, some or all of the lines 50 and 52 may be disposed generally parallel to some or all of the axes 62 and 66 and may be disposed in a generally perpendicular manner with respect to some or all of the axes 64 and 68. Also, some or all of the lines 54, 56, and 58 may be disposed generally parallel to some or all of the axes 64 and 68 and may be disposed in a generally perpendicular manner with respect to some or all of the axes 62 and 66. A shaped portion may have one or more diagonal axes or any other suitable axes. A shaped portion does not require any axis and does not require that any lines be in any particular orientation with respect to any axis.

In one embodiment, a shaped portion may have a shape that is generally symmetrical about one or more axes. A shaped portion may have a shape that is generally symmetrical about one or more central axes. A shaped portion may have a shape that is generally symmetrical about a generally vertical axis, a generally horizontal axis, or both. As shown in FIG. 1A, the shaped portion 32 may have a shape that is generally symmetrical about the axis 54, the axis 56, or both; and the shaped portion 34 may have a shape that is generally symmetrical about the axis 58, the axis 60, or both. As shown in FIG. 1B, the shaped portion 46 may have a shape that is generally symmetrical about the axis 62, the axis 64, or both; and the shaped portion 48 may have a shape that is generally symmetrical about the axis 66, the axis 68, or both. In one embodiment, a shaped portion may be symmetrical about one or more diagonal axes. Of course, a shaped portion need not be symmetrical about any axis.

In one embodiment, a side of the panel 2 may include one or more shaped portions that may generally aligned with one or more other shaped portions on that side of the panel 2. For example, a side of the panel 2 may include one or more shaped portions generally aligned with one or more other shaped portions along one or more axes. For example, as shown in FIGS. 1A and 1B, one or more sides of the panel 2 may include 6 columns and 16 rows of shaped portions. Some or all of the shaped portions in a column may be aligned generally along a generally vertical central axis. Some or all of the shaped portions in a row may be aligned generally along a generally horizontal central axis. A side of the panel 2 may have 1, 2, 3, 4 or any other suitable number of rows of shaped portions. A side of the panel 2 may have 1, 2, 3, 4 or any other suitable number of columns of shaped portions. Of course, a side of the panel 2 need not include columns of shaped portions or rows of shaped portions. Also, shaped portions on a side of a panel 2 may be aligned in any other suitable alignment or manner. Further, a side of the panel 2 does not require any shaped portions to be aligned.

In one embodiment, a side of the panel 2 may include one or more shaped portions on one side of the panel 2 are generally aligned with one or more other shaped portions on an opposing side of the panel 2. A shaped portion on one side of the panel 2 may have one or more axes that are generally aligned with one or more axes of a shaped portion on an opposing side of the panel 2. A shaped portion on one side of the panel 2 may have an axis that is generally aligned with one or more axes of one or more shaped portions on an opposing side of the panel 2. As shown in FIGS. 1A and 1B, the axis 54 of the shaped portion 32 may be generally aligned with the axis 62 of the shaped portion 46; and the axis 56 of the shaped portion 32 may be generally aligned with the axis 64 of the shaped portion 46. Thus, in one embodiment, a side of the panel 2 may include a shaped portion on one side of the panel 2 that may be generally aligned with a shaped portion on an opposing side of the panel 2 along a vertical axis, a horizontal axis, or both. Similarly, the axis 58 of the shaped portion 34 may be generally aligned with the axis 66 of the shaped portion 48; and the axis 60 of the shaped portion 34 may be generally aligned with the axis 68 of the shaped portion 48. Accordingly, in one embodiment, a side of the panel 2 may include a plurality of shaped portions on one side of the panel 2 that may be generally aligned with a corresponding shaped portion on an opposing side of the panel 2. A side of the panel 2 may include a column of one or more shaped portions that may be generally aligned with column of one or more shaped portions formed on an opposing side of the panel 2. A side of the panel 2 may include a row of one or more shaped portions that may be generally aligned with column of one or more shaped portions formed on an opposing side of the panel 2. A shaped portion on a side of a panel 2 may be aligned in any other suitable alignment or manner with a shaped portion formed on an opposing side of the panel 2. The panel 2 does not require that a shaped portion (or any columns or rows of shaped portions) be aligned with any shaped portion (or any columns or rows of shaped portions) formed on an opposing side of the panel 2.

In one embodiment, a side of the panel 2 may include a one or more lines that may be generally aligned with one or more lines on an opposing side of the panel 2. A side of the panel 2 may include a one or more lines that may be generally aligned along one or more axes with one or more lines on an opposing side of the panel 2. For example, as shown in FIGS. 1A and 1B, the line 36 may be generally aligned with the line 52 along a generally vertical axis, the line 38 may be generally aligned with the line 50 along a generally vertical axis, the line 40 may be generally aligned with the line 54 along a generally horizontal axis, the line 42 may be generally aligned with the line 56 along a generally horizontal axis, and the line 44 may be generally aligned with the line 58 along a generally horizontal axis. A line may be aligned with a line formed on an opposing side of the panel 2 in any other suitable alignment, orientation, or manner. The panel 2 does not require that a line on a side of the panel 2 be aligned along any axis with any line formed on an opposing side of the panel 2. Further, the panel 2 does not require that a line on a side of the panel 2 be aligned in any manner with any line formed on an opposing side of the panel 2.

A side of the panel 2 may include a pattern that may intersect at least a portion of one or more depressions. According, all or a portion of a depression (or a plurality of depressions) may be generally disposed within a pattern. In one embodiment, a side of the panel 2 may include one or more depressions that may be generally disposed within (or may otherwise intersect with) a pattern comprising one or more lines. For example, as shown in FIG. 1A, a pattern may include a line (such as, a line 70) within which all or a portion of one or more depressions (such as, depressions 72, 74, 76, 78, 80, 82 and 84) may be disposed. Similarly, as shown in FIG. 1A, the depressions 4, 6, and 12 may be disposed within the line 40; the depressions 8, 10, and 14 may be disposed within the line 42; the depressions 4 and 8 may be disposed within the line 36; and the depressions 6 and 10 may be disposed within the line 38. Likewise, as shown in FIG. 1B, the depressions 18, 20, and 26 may be disposed within the line 54; the depressions 22, 24, and 28 may be disposed within the line 56; the depressions 20 and 24 may be disposed within the line 50; and the depressions 18 and 22 may be disposed within the line 52. A depression may be disposed within one, two, or any other suitable number of lines. A depression may be disposed at the intersection of two, three, or any other suitable number of lines. A depression may be disposed at the intersection of two, three, or any other suitable number of substantially straight lines. A depression may be disposed at the intersection of two, three, or any other suitable number of curvilinear lines. A depression may be disposed at the intersection of two substantially perpendicular lines. A side of the panel 2 may include one or more depressions that may be generally disposed within a pattern comprising one or more generally horizontal lines and one or more generally vertical lines. A plurality of three or more depressions may be disposed in a generally equidistant manner within a line. For example, as shown in FIG. 1A, the depression 74 may be spaced apart from the depression 76 and the depression 72 at about the same distance; the depression 76 may be spaced apart from the depression 74 and the depression 78 at about the same distance; the depression 76 may be spaced apart from the depression 74 and the depression 78 at about the same distance; the depression 78 may be spaced apart from the depression 76 and the depression 80 at about the same distance; the depression 80 may be spaced apart from the depression 78 and the depression 82 at about the same distance; and the depression 82 may be spaced apart from the depression 80 and the depression 84 at about the same distance. A plurality of three or more depressions may be disposed in a generally equidistant manner within a curved line, a substantially straight line, or a line having any other suitable configuration. A plurality of three or more depressions may be disposed in a generally equidistant manner within a substantially vertical line or a substantially horizontal line. The panel 2 does not require a depression to be disposed in any particular location with respect to any other depression. A side of the panel 2 may include one or more depressions that may be generally disposed proximate one or more lines in any suitable design. A side of the panel 2 may include one or more depressions that may be spaced apart from one or more lines in any suitable design. Of course, a pattern does not require straight lines, vertical lines, horizontal lines, or any lines at all. Further, the panel 2 does not require a depression to be disposed within any line, at the intersection of any lines, or in any particular location with respect to any line.

In one embodiment, a side of the panel 2 may include a depression on one side of the panel 2 that may be generally aligned with a depression on an opposing side of the panel 2. As shown in FIGS. 1A and 1B, depressions 4 and 18 may be aligned, depressions 6 and 20 may be aligned, depressions 8 and 22 may be aligned, depressions 10 and 24 may be aligned, depressions 12 and 26 may be aligned, depressions 14 and 28 may be aligned, and depressions 16 and 30 may be aligned. Opposing depressions may be disposed within patterns on the opposing surfaces, but opposing depressions do not have to be disposed within a pattern. Opposing depressions may extend towards each other and may also contact each other. Opposing depressions may be integrally formed in the panel 2. Opposing depressions may be sized and configured to increase the strength of the panel 2. Desirably, opposing depressions may be sized and configured to engage or abut proximate the center of the panel 2. For example, the depressions 4 and 18 may be sized and configured to engage or abut proximate the center of the panel 2. Accordingly, the opposing surfaces of the panel 2 may be interconnected at any suitable locations. Of course, a depression on one side of the panel 2 need not be aligned with, extend toward, or contact a depression on an opposing side of the panel 2.

Advantageously, because the depressions may be formed on opposing sides of a panel and because the depressions may intersect one or more patterns; panels with pleasing aesthetics may be constructed. In addition, because the depressions may be formed on opposing sides of a panel and because the depressions may intersect one or more patterns; generally symmetrical panels may be constructed, helping the panels to be easily interchanged and reversed.

The patterns and/or depressions on both sides of the panels may help panels of various designs and configurations to be constructed. The panels may also be constructed without visual defects and imperfections. Additionally, the patterns and/or depressions may be used to hide or conceal visual defects, imperfections, or other features in the panels.

The patterns and/or depressions may be used to create panels with generally consistent strength and structural integrity to be constructed. For example, because both sides of a panel may be generally the same, the opposing sides may have similar physical properties and characteristics. However, it will be understood that the sides of the panels do not have to be the same and the panels may have a variety of suitable properties and characteristics.

Significantly, if the opposing sides of the panels have a generally similar pattern and/or configuration, the panels may cool more evenly than panels with different patterns and configurations. This may allow the panels to be removed from the mold faster, which may reduce cycle time. This may also reduce the time required to manufacture the panels, which may allow the cost of the panels to be decreased.

The panels may be constructed with a generally hollow interior portion. This interior portion may be hollow or all or a portion of the interior portion may be filled with a material such as foam. The foam, or other suitable material, may create a core or center portion of the panel. The type of foam or filler material may depend upon the intended use of the panels. For example, the foam or filler may be used to insulate the panel. In particular, the foam or filler may be used to provide sound and/or heat insulation. The foam or filler is preferably lightweight, but the characteristics of the foam or filler may depend upon the intended use of the panel.

Figure 3:
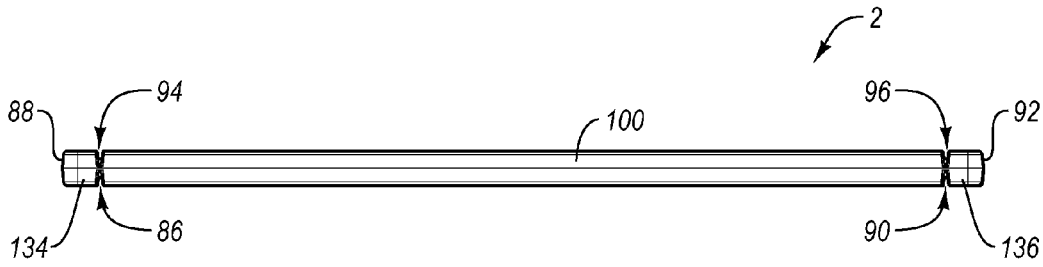
FIG. 3 is a top view of the panel or partition shown in FIG. 1.
Figure 4:
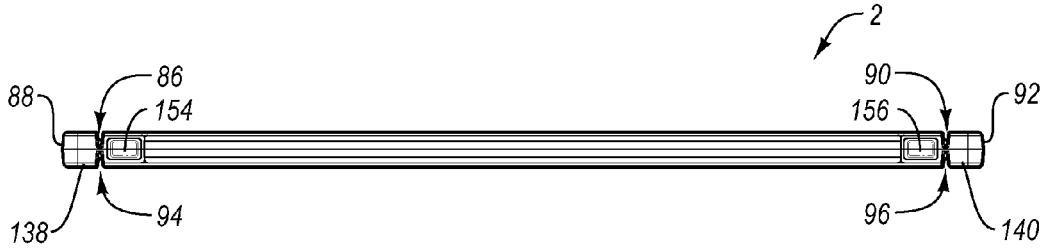
FIG. 4 is a bottom view of the panel or partition shown in FIG. 1.

FIG. 2A is a left side view of the panel 2 (FIGS. 1A and 1B), FIG. 2B is a right side view of the panel 2, FIG. 3 is a top view of the panel 2, and FIG. 4 is a bottom view of the panel 2. As shown in FIGS. 1A, 1B, 2A, 2B, 3, and 4, the panel 2 preferably includes a border or edge disposed about the perimeter of the panel 2. A border may extend along all or a portion of a side of the panel 2. One or more sides of the panel 2 may include a border. The border may provide protection for the panel. The border is preferably rounded or curved, but may have any other shape and/or other characteristics.

In one embodiment, a groove or slot may be disposed proximate a side or edge of the panel 2. A groove may extend along all or a portion of a side of the panel. A groove may be curved, substantially straight, or have any other suitable configuration. Some or all of the sides of the panel may each be disposed proximate at least one groove. As shown in FIGS. 1A, 1B, 2A, 2B, 3, and 4, a groove 86 may be disposed proximate a side 88 of the panel 2, a groove 90 may be disposed proximate a side 92 of the panel 2, a groove 94 may be disposed proximate the side 88, and a groove 96 may be disposed proximate the side 92. Also, as shown in FIGS. 1A, 1B, 2A, 2B, and 3, a groove 98 may be disposed proximate a top surface 100 of the panel 2, and a groove 102 may be disposed proximate the top surface 100. Thus, a groove may be disposed along some or all sides of the panel 2 and/or along a top surface of the panel 2, but it will be understood that any other desired portions of the panel 2 may include a groove. Further, grooves are optional, and, thus, the panel 2 does not require any groove.

Figure 5:
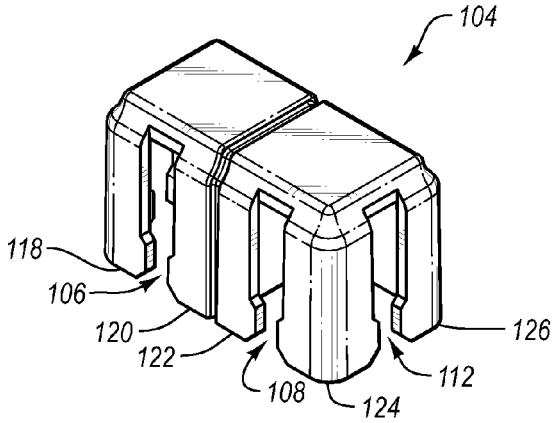
FIG. 5 is a perspective view of an exemplary embodiment of a connector that may be used to connect one or more panels or partitions, such as shown in FIG. 1.
Figure 8:
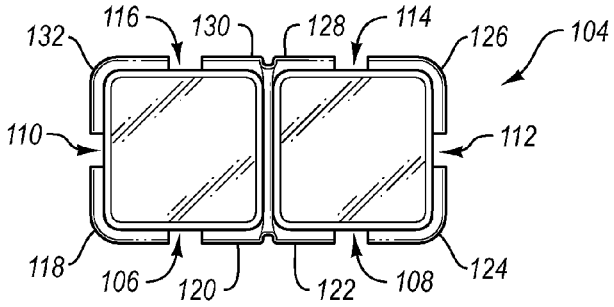
FIG. 8 is a top view of the connector shown in FIG. 5.
Figure 6A:
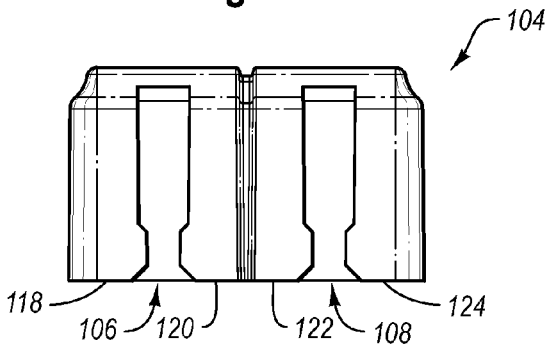
FIG. 6A is a front view of the connector shown in FIG. 5.
Figure 9A:
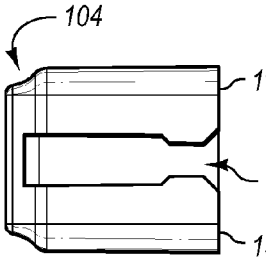
FIG. 9A is a left side view of the connector shown in FIG. 5.
Figure 7:
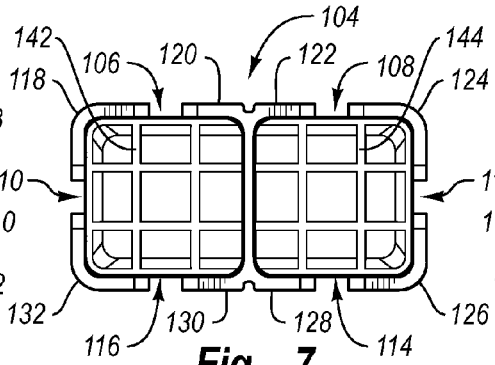
FIG. 7 is a bottom view of the connector shown in FIG. 5.
Figure 9B:
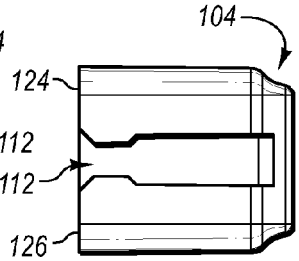
FIG. 9B is a right side view of the connector shown in FIG. 5.
Figure 6B:
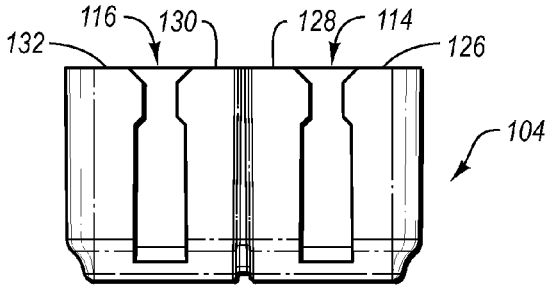
FIG. 6B is a rear view of the connector shown in FIG. 5.

FIG. 5 is a perspective view of a connector 104 that may advantageously be used to connect a plurality of panels, such as, the panel 2 (FIGS. 1A-4) according to an embodiment of the invention. FIG. 6A is a front view of the connector 104. FIG. 6B is a rear view of the connector 104. FIG. 7 is a bottom view of the connector 104. FIG. 8 is a top view of the connector 104. FIG. 9A is a left side view of the connector 104. FIG. 9B is a right side view of the connector 104. It will be appreciated that the connector 104 is optional and any other suitable connector, fastener, adhesive, or the like may be used to connect or interlock a plurality of panels 2.

As shown in FIGS. 5-9B, the connector 104 may be used to interconnect a plurality of panels 2. The connector 104 preferably has sufficient structural integrity to securely interconnect a plurality of panels. The connector 104 is preferably a universal type connector that may interconnect panels of various sizes and configurations.

In one embodiment, the connector 104 may include 1, 2, 3, 4, 5, 6, or any other suitable number of slots or grooves that may be advantageously sized and configured to mate and/or align with one or more slots or grooves formed in a panel. As shown in FIGS. 5-9B, the connector 104 may include slots 106, 108, 110, 112, 114, and 116. The connector 104 may include one or more flanges. In one embodiment, the connector 104 may include a plurality of flanges or extensions that may form one or more slots. For example, flanges 118 and 120 may form the slot 106, flanges 122 and 124 may form the slot 108, flanges 126 and 128 may form the slot 114, flanges 130 and 132 may form the slot 116, the flanges 118 and 132 may form the slot 110, and the flanges 124 and 126 may form the slot 112.

The connector 104 may include one or more portions sized and configured to receive an outer portion of the panel 2. The connector 104 may include one or more portions sized and configured to receive a portion of a border or edge of the panel 2. For example, flanges 118, 120, 130, and 132 (FIGS. 5-9B) may form a generally square-shaped receiving portion adapted to receive some or all of generally square-shaped portions 134, 136, 138, and 140 (FIGS. 3 and 4). Similarly, flanges 122, 124, 126, and 128 (FIGS. 5-9B) may form a generally square-shaped receiving portion adapted to receive some or all of generally square-shaped portions 134, 136, 138, and 140 (FIGS. 3 and 4). Thus, the connector 104 may advantageously include a first portion sized and configured to receive an outer portion of a first panel and a second portion sized and configured to receive an outer portion of a second panel. Also, the connector 104 may advantageously include one, two, or more receiving portions each adapted to be disposed at (or contact or otherwise engage) one surface, two surfaces, three surfaces, four surfaces or any other suitable number of surfaces of a panel. Accordingly, the connector 104 may advantageously include a first portion sized and configured to receive a top portion (such as, the portions 134 and 136) of a first panel and a second portion sized and configured to receive a top portion (such as, the portions 134, 136) of a second panel. Further, the connector 104 may advantageously include a first portion sized and configured to receive a bottom portion (such as, the portions 138 and 140) of a first panel and a second portion sized and configured to receive a bottom portion (such as, the portions 138 and 140) of a second panel. Of course, the connector 104 and the panel 2 may include any other suitable portions having other suitable shapes and/or configurations that may be used to interconnect a plurality of panels 2.

The connector 104 may include one or more flanges or extensions that may advantageously be sized and configured to be inserted into (or otherwise mate with or engage) one or more grooves or slots formed in the panel 2. For example, in one embodiment, a pair of flanges (such as, the flanges 118 and 120, the flanges 122 and 124, the flanges 126 and 128, the flanges 130 and 132, the flanges 118 and 132, the flanges 124 and 126, or the like) may be aligned with and inserted into (or otherwise mate with or engage) a pair of grooves or slots formed in the panel 2 (such as, the grooves 86 and 94, the grooves 90 and 96, or the like).

The connector 104 may include one or more support structures that may advantageously be sized and configured to structurally support the connector 104. For example, in one embodiment, one or more braces (such as, braces 142 and 144) may be connected to one or more interior walls of the connector 104. One or more such braces may be formed integrally with the connector 104. As illustrated, one or more braces may be aligned in a horizontal alignment, a vertical alignment, or both. Further, one or more braces may be aligned in a perpendicular alignment with respect to one or more other braces. Of course, any number of braces may be aligned, formed, and configured in any other suitable manner. Further, such braces are optional and not required by the connector 104.

The connector 104 may be connected to one or more panels 2 by an interference fit, a friction fit, a snap fit, a fastener, an adhesive, any other suitable means for connecting the connector 104 to one or more panels 2, or any suitable combination thereof.

One or more connectors 104 may be used to interconnect or interlock one or more panels 2. Desirably, the connectors may be interchangeable and may be sized and configured to allow a plurality of panels 2 to be connected in a variety of different configurations. For example, one or more connectors 104 may be configured to connect a plurality of panels in a line, planar arrangement, curved, rounded or other suitable configuration. One or more connectors 104 may also be configured to connect a plurality of panels 2 at a right angle or any other desired angle. One or more connectors 104 may also be configured to connect a plurality of panels 2 in an offset, parallel arrangement. One or more connectors 104 may also be configured to interconnect three, four, or even more panels at one time.

One or more connectors 104 desirably provide a relatively straightforward and simple method for connecting a plurality of panels 2. The connector 104 may be constructed from plastic including injection-molded plastic, extrusion-molded plastic, or the like. It will be appreciated, however, that the connector 104 may be constructed from any desired method and with any suitable materials, such as metal, depending, for example, upon the intended use of the connector 104. Advantageously, the connector 104 allows a plurality of panels 2 to be interconnected without a frame, but a frame could be used if desired.

The connector 104 may be used to interconnect a plurality of panels 2 without tools, but tools could be used if desired. Advantageously, using one or more connectors 104, a plurality of panels 2 may be easily interconnected and disconnected. This also allows various types and configurations of structures to be created. In addition, because tools are not required, consumers can easily connect and disconnect a plurality of panels 2. This allows such panels to be packaged and shipped in an unassembled or unconnected manner, which may reduce shipping and/or manufacturing costs. It will be appreciated that other types of connectors may be used in addition to, in connection with, or in lieu of one or more connectors 104. For example, rivets, screws, bolts, adhesives, and the like may be used to connect a plurality of panels 2.

Figure 10:
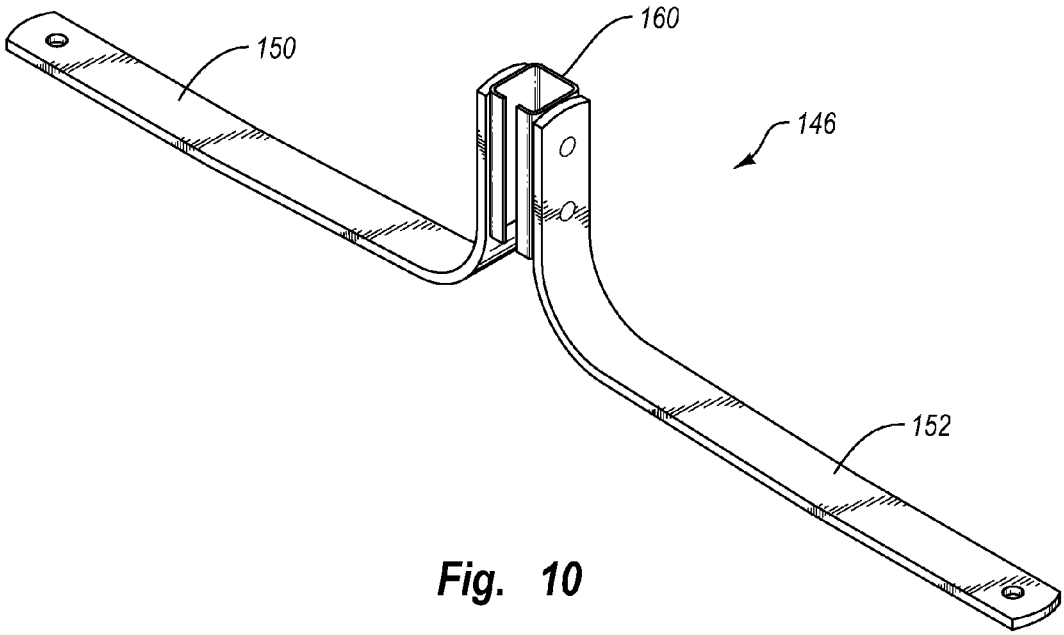
FIG. 10 is a perspective view of an exemplary embodiment of a foot that may be used in connection with one or more panels or partitions, such as shown in FIG. 1.
Figure 11:
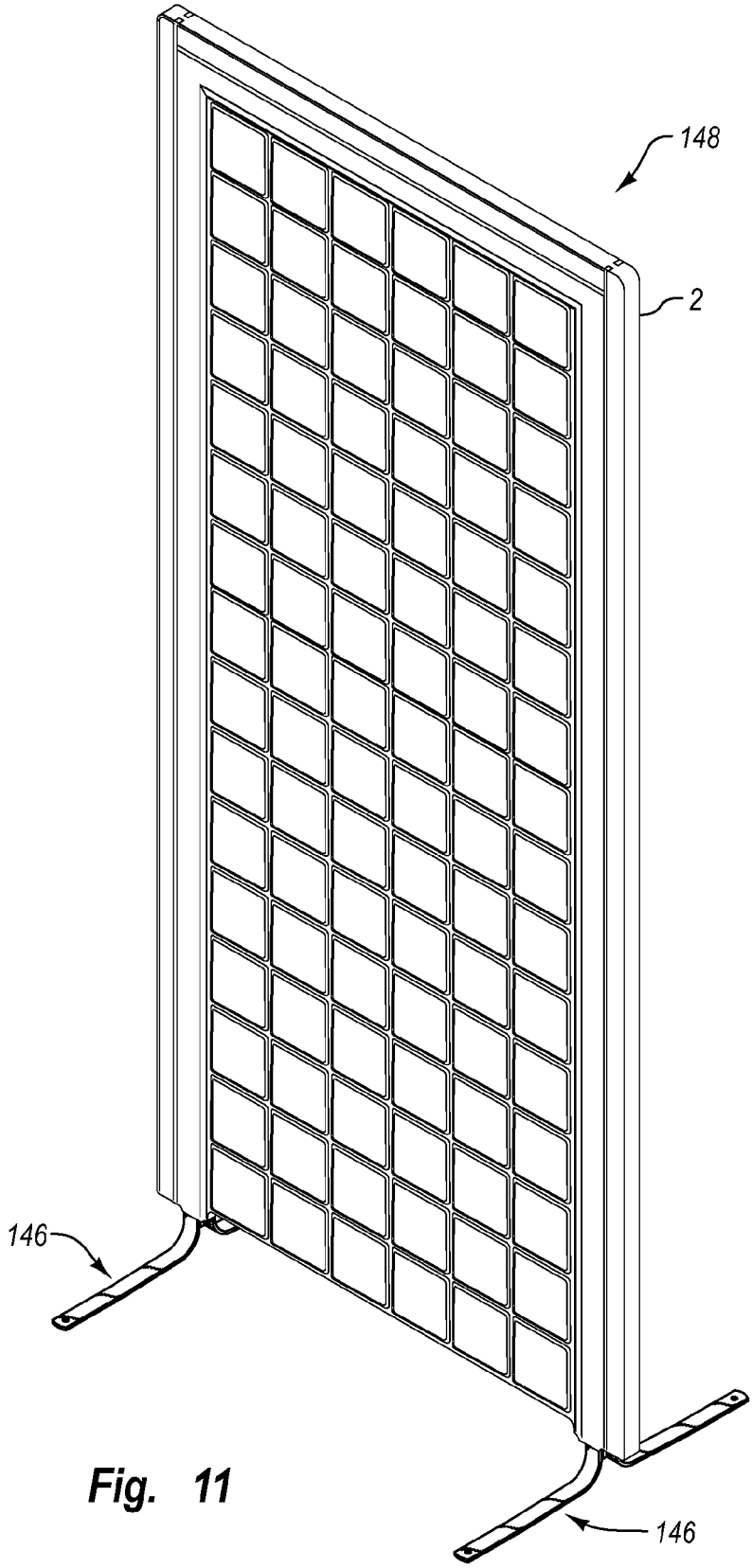
FIG. 11 is a perspective view of a pair of feet as shown in FIG. 10, that may be used in connection with a panel or partition shown in FIG. 1.

FIG. 10 is a perspective view of a foot 146, one or more of which may be used to arrange the panel 2 (FIG. 1) in a desired configuration, orientation, and/or position, according to an embodiment of the invention. FIG. 11 is a perspective view of a partition system 148 in which a one or more feet 146 (FIG. 10) may be used to position the panel 2 (FIG. 1) in a generally upright or generally vertical orientation. Of course, one or more feet 146 could be used to position the panel 2 in an angled orientation having any other suitable angle. One or more feet 146 may also be used to interconnect or interlock one or more panels 2. It will be appreciated that the panel 2 may be arranged in any desired configuration, orientation, and/or position with one or more feet 146 in combination with any number of other suitable components. Further, the panel 2 may be arranged in any desired configuration, orientation, and/or position without any feet 146, which are optional.

FIG. 12 is a front view of the foot 146. FIG. 13 is a bottom view of the foot 146. FIG. 14 is a top view of the foot 146. FIG. 15A is a left side view of the foot 146. FIG. 15B is a right side view of the foot 146.

As shown in FIGS. 11-15, one or more feet 146 may be connected to the panel 2. The panel 2 may be connected to one or more feet 146 using a friction fit, a snap fit, and interference fit, or in any other suitable manner. In one embodiment, the foot 146 may be connected to the panel 2 by inserting at least a portion of the foot 146 into an opening, groove, or channel formed in the panel 2. The foot 146 may include a plurality of flanges (such as, flanges 150 and 152). The flanges 150 and 152 may advantageously be sized and configured to be inserted into an opening formed in the panel 2 (such as, openings 154 and 156 in FIG. 4, or the like). Advantageously, when inserted into an opening formed in the panel 2, the flanges 150 and 152 may be securely attached to the panel 2 using a friction fit, a snap fit, and interference fit, a fastener, an adhesive, or any suitable combination thereof. In one embodiment, the foot 146 may be connected to the panel 2 by inserting at least a portion of the panel 2 (such as, the portions 138 and 140) into an opening, groove, or channel formed in the foot 146, such as, for example, an opening 158. In one embodiment, the foot 146 includes a bracket member 160, which may form the opening 158. Advantageously, when inserted into an opening formed in the foot 146, the inserted portion of the panel 2 may be securely attached to the foot 146 using a friction fit, a snap fit, and interference fit, a fastener, an adhesive, or any suitable combination thereof. The bracket member 160 may be attached to one or more flanges (such as the flanges 150 and 152) in any suitable manner. The bracket member 160 may be formed integrally with one or more flanges. Of course, one or more feet 146 may be connected to the panel 2 in any other suitable manner using any number of suitable connectors, fits, fasteners, adhesives, and the like.

Figure 16:
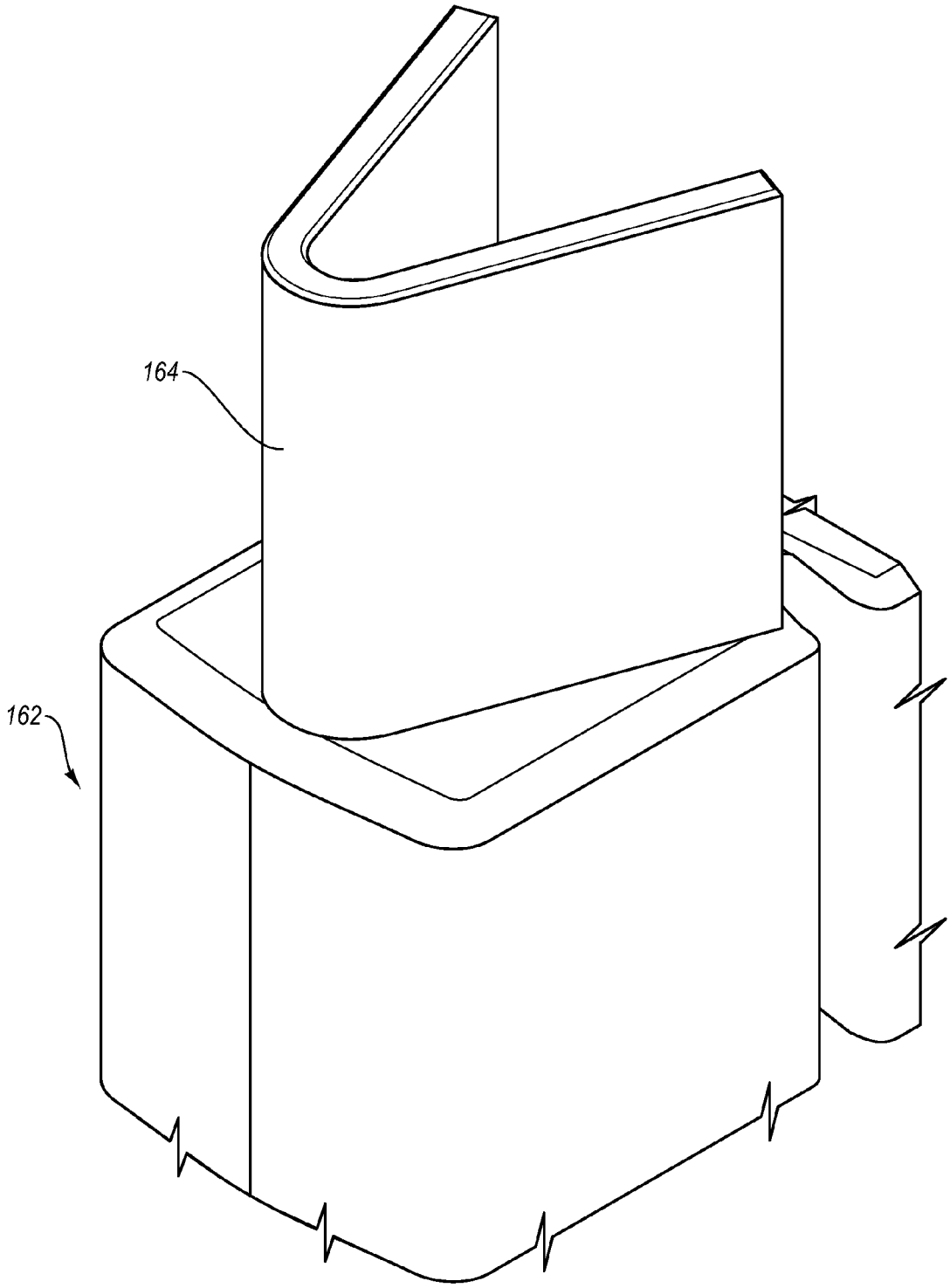
FIG. 16 is an enlarged perspective view of another exemplary embodiment of a portion of a panel or partition.
Figure 17:
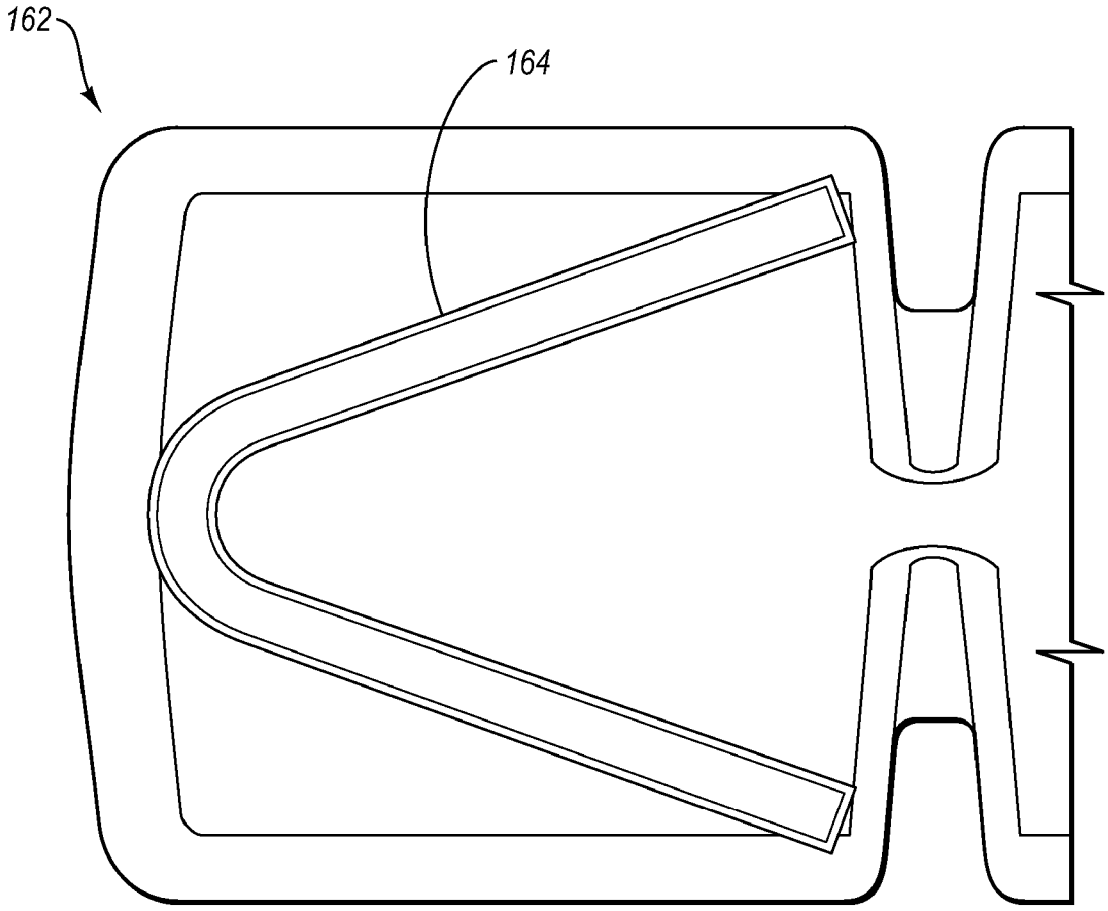
FIG. 17 is a top view of the portion of the panel or partition shown in FIG. 16.
Figure 18:
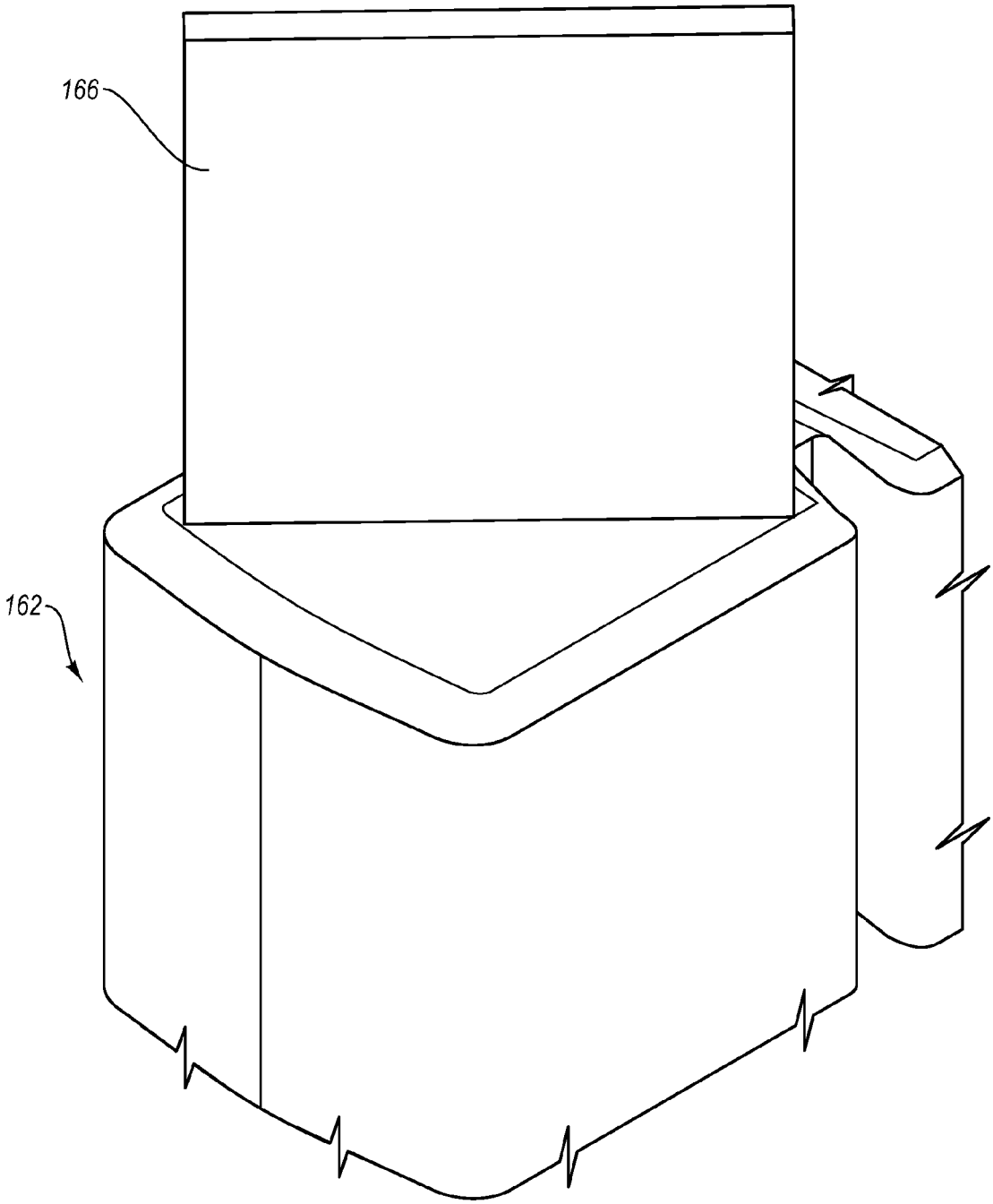
FIG. 18 is an enlarged perspective view of yet another exemplary embodiment of a portion of a panel or partition that may be used with a partition system.
Figure 19:
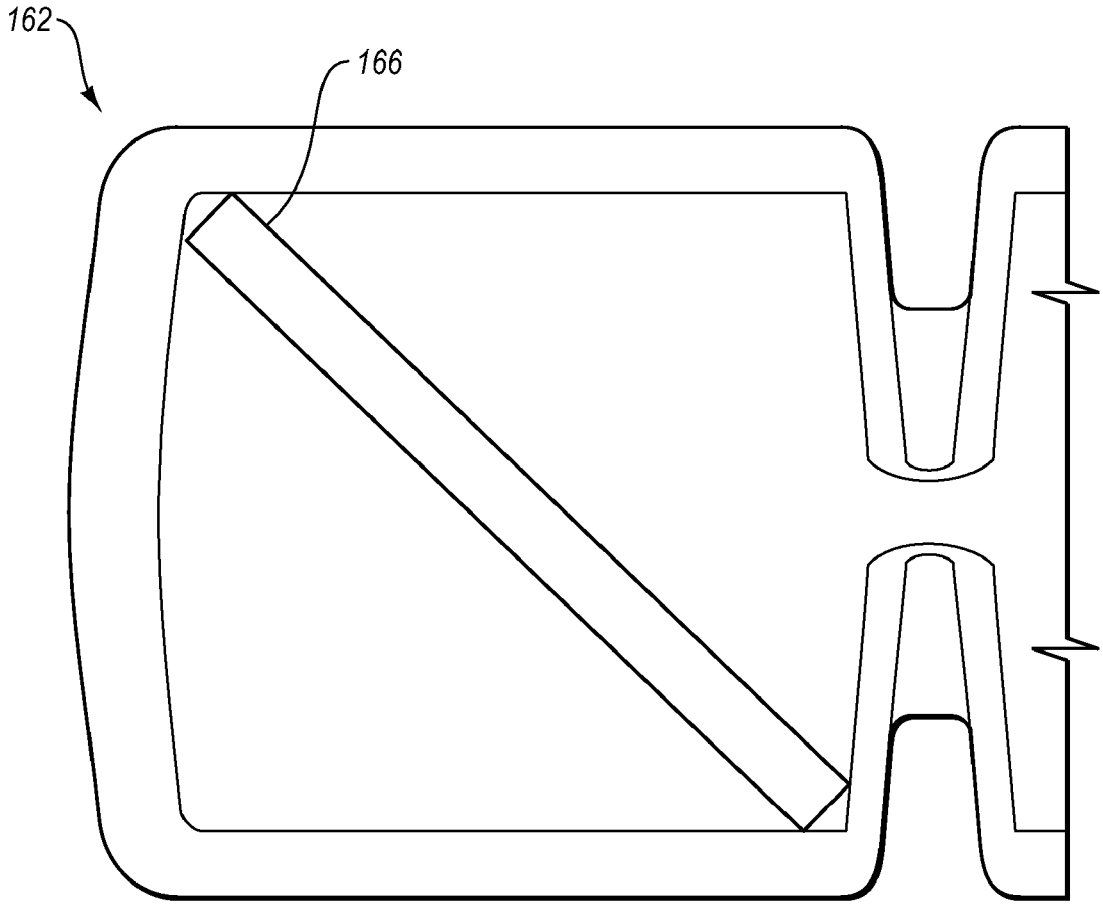
FIG. 19 is a top view of the portion of the panel or partition shown in FIG. 18.
Figure 20:
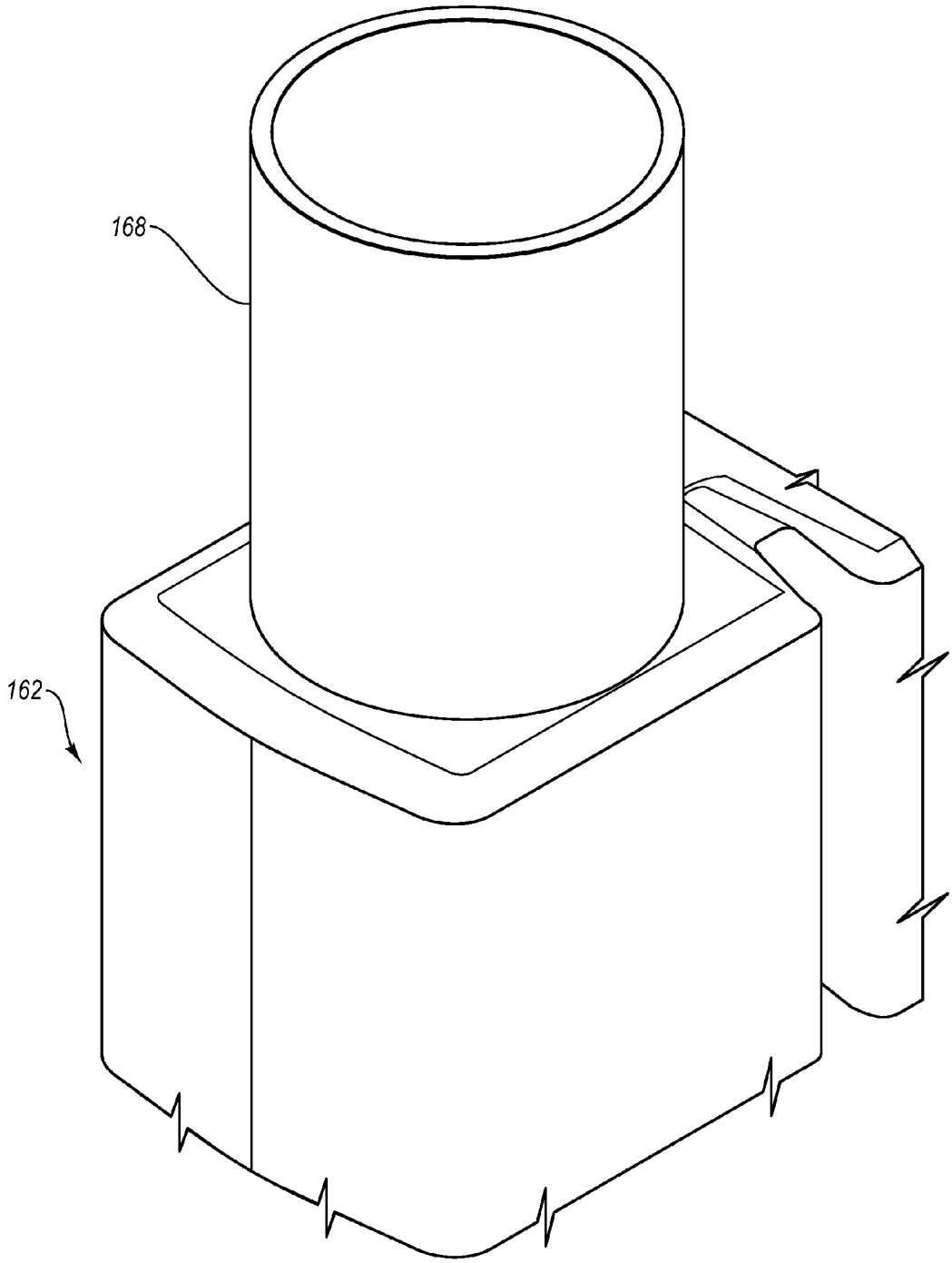
FIG. 20 is an enlarged perspective view of still another exemplary embodiment of a portion of a panel or partition that may be used with a partition system.
Figure 21:
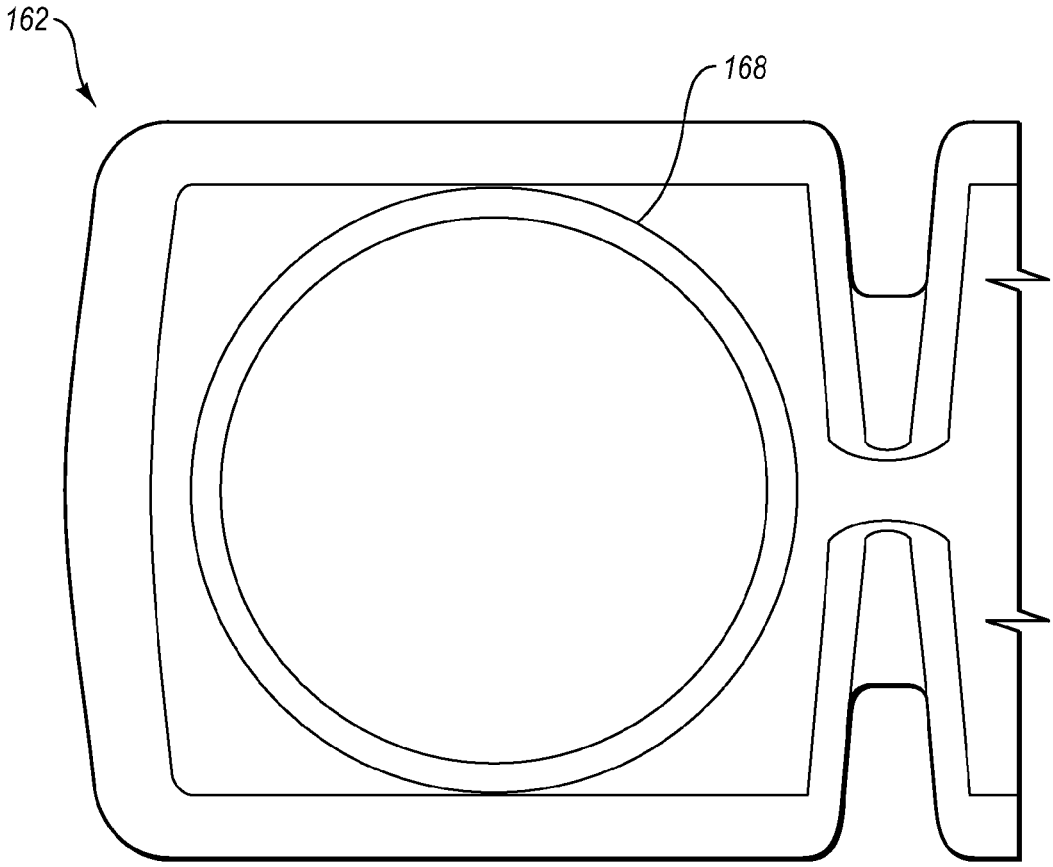
FIG. 21 is a top view of a portion of the panel or partition shown in FIG. 20.
Figure 22:
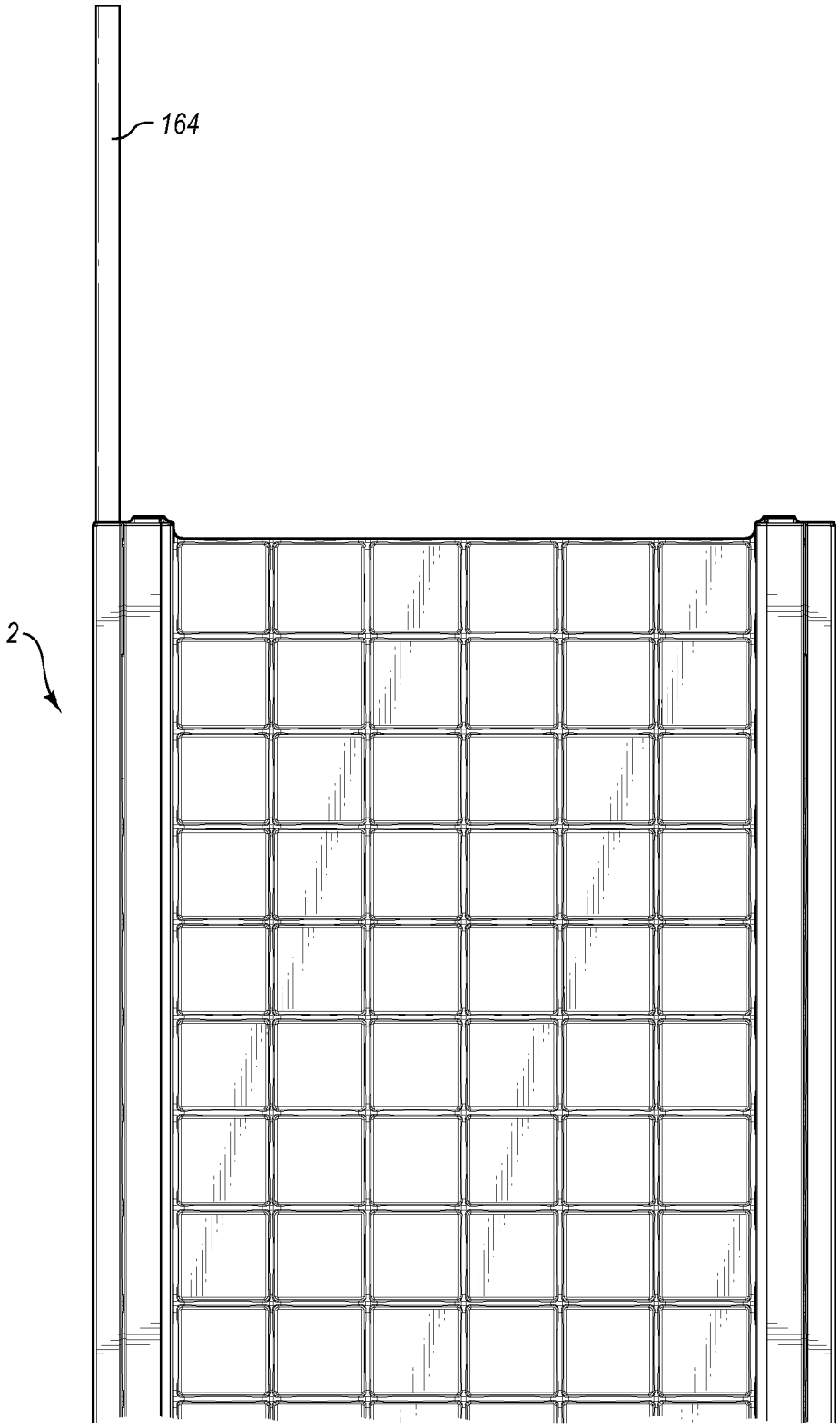
FIG. 22 is a side view of a further exemplary embodiment of a portion of a panel or partition that may be used with a partition system.

As shown in FIGS. 16, 17, 18, 19, 20, 21, and 22, a panel (such as, the panel 2) may include one, two, or more reinforcement members. FIG. 16 is a perspective view of a portion of an embodiment of a panel 162, which may include a reinforcement member 164. FIG. 17 is an enlarged top view of a portion of the panel 162 (FIG. 16) and the reinforcement member 164 (FIG. 16). FIG. 18 is a perspective view of a portion of an embodiment of the panel 162, which may include a reinforcement member 166. FIG. 19 is an enlarged top view of a portion of the panel 162 (FIG. 18) and the reinforcement member 166 (FIG. 18). FIG. 20 is a perspective view of a portion of an embodiment of the panel 162, which may include a reinforcement member 168. FIG. 21 is an enlarged top view of a portion of the panel 162 (FIG. 20) and the reinforcement member 168 (FIG. 20). FIG. 22 is a side view of a portion of an embodiment of the panel 2, which may include the reinforcement member 164 (FIG. 16). As shown in FIGS. 16-22, one, two, or more edges of a panel (such as, the panel 2) may include a reinforcement member. In one embodiment, a reinforcement member may be disposed proximate at least a portion of an edge of the panel, and the reinforcement member may be sized and configured to reinforce all or a portion of the edge of the panel. A reinforcement member may be disposed along more than one edge and may extend along all or a portion of those edges. It will be appreciated that all or a portion of a reinforcement member may also be disposed away from an edge of a panel. A reinforcement member may be added to a panel after the panel has been formed, may be formed integrally with the panel, or may be constructed as part of the panel in any other suitable manner. The reinforcement member may be constructed from plastic, metal, wood, or any other suitable material having appropriate characteristics. A reinforcement member may advantageously be constructed of a lightweight, strong, and rigid material that may provide portions of a panel with a more durable construction that may resist damage. Of course, a reinforcement member may have any of those and/or any other appropriate characteristics, depending upon, for example, on the intended use or purpose of the reinforcement member. It will be appreciated that a panel does not require any reinforcement members, which are optional.

As shown in FIGS. 16 and 17, the reinforcement member 164 may have generally V-shaped or angled configuration. The reinforcement member 164 may form an angle of about 40 degrees, about 50 degrees, about 90 degrees, less than 90 degrees, greater than 90 degrees, or any other desired angle and may have other suitable shapes and sizes. The reinforcement member 164 may include a rounded angle, but could include a sharp angle. The reinforcement member 164 may be disposed within (or proximate to) a border or edge of the panel 162 and may contact or engage one, two, three, or more walls of the border or edge of the panel 162. The reinforcement member 164 need not be disposed within, disposed proximate to, contact, or engage any portion of a border or edge of the panel 162.

As shown in FIGS. 18 and 19, a reinforcement member 166 may have a generally planar configuration and may be disposed at an angle with respect to the panel 162. It will be appreciated that the reinforcement member could be disposed at any desired angle and may have other suitable shapes and sizes. The reinforcement member 166 may be disposed within (or proximate to) a border or edge of the panel 162 and may contact or engage one, two, three, four, or more walls of the border or edge of the panel 162. The reinforcement member 166 need not be disposed within, disposed proximate to, contact, or engage any portion of a border or edge of the panel 162.

As shown in FIGS. 20 and 21, a reinforcement member 168 may be a tube with a generally circular configuration. The reinforcement member 168 may be a rod. The reinforcement member 168 may have a generally square shape or cross section, a generally rectangular shape or cross section, a generally elliptical or oval shape or cross section, a generally polygonal shape or cross section, an irregular shape or cross section, or any other appropriate shape or cross section. The reinforcement member 168 may be generally hollow, may be generally solid, or may have any other suitable construction. The reinforcement member 168 may be disposed within (or proximate to) a border or edge of the panel 162 and may contact or engage one, two, three, four, or more walls of the border or edge of the panel 162. The reinforcement member 168 need not be disposed within, disposed proximate to, contact, or engage any portion of a border or edge of the panel 162.

A reinforcement member—such the reinforcement member 164 (FIG. 16), the reinforcement member 166 (FIG. 18), the reinforcement member 168 (FIG. 20), or the like—may extend outwardly from the panel, may be disposed within the panel, or both. A reinforcement member may extend outwardly from a top surface of a panel (such as, portions 134 and 136 in FIG. 3), a bottom surface of a panel (such as, portions 138 and 140 in FIG. 4), any other surface of a panel, or any suitable combination thereof. As shown in FIG. 22, the panel 2 (FIG. 1) may include a reinforcement member 164 (FIG. 16) that may extend outwardly from the panel 2.

One skilled in the art will appreciate that a reinforcement member—such the reinforcement member 164 (FIG. 16), the reinforcement member 166 (FIG. 18), the reinforcement member 168 (FIG. 20), or the like may have other suitable shapes, sizes, and arrangements, and a panel could have more than one reinforcement member.

Advantageously, some or all of the panels, connectors, and feet described herein may form a partition system that is easy to assemble, disassemble, ship, transport, and construct into a variety of suitable configurations and arrangements. Additionally, because the components may be interchangeable, that increases the potential uses of the system. Further, because both sides of the panels may be the same and one or more depressions may be formed in both sides of the panels, the symmetrical panels may be reversible and interchangeable. Finally, the panels provide improved aesthetics and the panels may be formed without visual defects or imperfections.

Although this invention has been described in terms of certain preferred embodiments, other embodiments apparent to those of ordinary skill in the art are also within the scope of this invention.

What is claimed is:

1. A panel constructed from blow-molded plastic, the panel including a length, a width and a thickness, the panel comprising:

a first outer surface;

a second outer surface;

a hollow interior portion at least partially disposed between the first outer surface and the second outer surface, the hollow interior portion being formed during the blow-molding process, the first outer surface, the second outer surface and the hollow interior portion being formed as part of a unitary, one-piece structure during the blow-molding process; and a metal reinforcing member at least substantially disposed within the hollow interior portion, the metal reinforcing member having different characteristics than the blow-molded plastic, the metal reinforcing member being sized and configured to increase the strength of the panel, the metal reinforcing member comprising:

a first portion that contacts an inner portion of the first outer surface; and a second portion that contacts an inner portion of the second outer surface.

2. The panel as in claim 1, wherein the metal reinforcing member is disposed proximate an edge of the panel.

3. The panel as in claim 1, wherein the metal reinforcing member is a thin strip of metal that extends from a first end of the panel to a second end of the panel.

4. The panel as in claim 1, wherein the metal reinforcing member is a thin strip of metal and a first edge of the thin strip engages the inner portion of the first outer surface and a second edge of the thin strip engages the inner portion of the second outer surface.

5. The panel as in claim 1, wherein the metal reinforcing member is a thin strip of metal that extends at least a majority of the length of the panel.

6. The panel as in claim 1, wherein the metal reinforcing member is a thin strip of metal that extends at least substantially the entire length of the panel.

7. The panel as in claim 1, wherein the metal reinforcing member has a generally V-shaped configuration, the generally V-shaped metal reinforcing member including a first edge that contacts the inner portion of the first outer surface and a second edge that contacts the inner portion of the second outer surface.

8. The panel as in claim 1, wherein the metal reinforcing member has a generally planar configuration, the generally planar metal reinforcing member including a first edge that contacts the inner portion of the first outer surface and a second edge that contacts the inner portion of the second outer surface.

9. The panel as in claim 1, wherein the metal reinforcing member has a generally circular configuration, the generally circular metal reinforcing member including a first side that contacts the inner portion of the first outer surface and a second side that contacts the inner portion of the second outer surface.

10. The panel as in claim 1, wherein the metal reinforcing member is completely enclosed within the panel.

11. The panel as in claim 1, wherein a portion of the metal reinforcing member extends beyond the panel.

12. The panel as in claim 1, further comprising a first pattern on the first outer surface and a second pattern on the second outer surface, wherein at least a portion of the first pattern contacts at least a portion of the second pattern.

13. The panel as in claim 1, further comprising a first pattern including one or more grooves in the first outer surface and a second pattern including one or more grooves in the second outer surface, wherein at least a portion of the grooves in the first outer surface contact at least a portion of the grooves in the second outer surface.

14. The panel as in claim 1, further comprising a first pattern on the first outer surface and a second pattern on the second outer surface, the first pattern including one or more depressions that contact the inner portion of the second outer surface, the second pattern including one or more depressions that contact the inner portion of the first outer surface.

15. A panel constructed from blow-molded plastic, the panel including a length, a width and a thickness, the panel comprising:

a first outer surface;

a second outer surface;

a hollow interior portion at least partially disposed between the first outer surface and the second outer surface, the hollow interior portion being formed during the blow-molding process, the first outer surface, the second outer surface and the hollow interior portion being formed as part of a unitary, one-piece structure during the blow-molding process;

a first pattern on the first outer surface, the first pattern including one or more depressions that extend from the first outer surface to the second outer surface;

a second pattern on the second outer surface, the second pattern including one or more depressions that extend from the second outer surface to the first outer surface; and a metal reinforcing member at least substantially disposed within the hollow interior portion, the metal reinforcing member having different characteristics than the blow-molded plastic, the metal reinforcing member being sized and configured to increase the strength of the panel.

16. The panel as in claim 15, wherein the metal reinforcing member includes a first portion that contacts an inner portion of the first outer surface and a second portion that contacts an inner portion of the second outer surface.

17. The panel as in claim 15, wherein the metal reinforcing member is disposed proximate an edge of the panel.

18. The panel as in claim 15, wherein the metal reinforcing member is a thin strip of metal that extends from a first end of the panel to a second end side of the panel.

19. The panel as in claim 15, wherein the metal reinforcing member is a thin strip of metal and a first edge of the thin strip engages an inner portion of the first outer surface and a second edge of the thin strip engages an inner portion of the second outer surface.

20. The panel as in claim 15, wherein the metal reinforcing member is a thin strip of metal that extends at least substantially the entire length of the panel.

21. The panel as in claim 15, wherein at least a portion of the first pattern contacts at least a portion of the second pattern.

22. The panel as in claim 15, wherein the first pattern includes one or more grooves in the first outer surface and the second pattern includes one or more grooves in the second outer surface, wherein at least a portion of the grooves in the first outer surface contact at least a portion of the grooves in the second outer surface.

23. A shed comprising:

a first wall constructed from blow-molded plastic, the first wall including a length, a width and a thickness, the first wall comprising:

a first outer surface;

a second outer surface;

a hollow interior portion at least partially disposed between the first outer surface and the second outer surface, the hollow interior portion being formed during the blow-molding process, the first outer surface, the second outer surface and the hollow interior portion being formed as part of a unitary, one-piece structure during the blow-molding process; and a metal reinforcing member at least substantially disposed within the hollow interior portion, the metal reinforcing member having different characteristics than the blow-molded plastic, the metal reinforcing member being sized and configured to increase the strength of the first wall, the metal reinforcing member including a first portion that contacts an inner portion of the first outer surface and a second portion that contacts an inner portion of the second outer surface; and a second wall constructed from blow-molded plastic, the second wall including a length, a width and a thickness, the second wall comprising:

a first outer surface;

a second outer surface;

a hollow interior portion at least partially disposed between the first outer surface and the second outer surface, the hollow interior portion being formed during the blow-molding process, the first outer surface, the second outer surface and the hollow interior portion being formed as part of a unitary, one-piece structure during the blow-molding process; and a metal reinforcing member at least substantially disposed within the hollow interior portion, the metal reinforcing member having different characteristics than the blow-molded plastic, the metal reinforcing member being sized and configured to increase the strength of the second wall, the metal reinforcing member including a first portion that contacts an inner portion of the first outer surface and a second portion that contacts an inner portion of the second outer surface.

24. The shed as in claim 23, wherein the metal reinforcing member of the first wall is disposed proximate an edge of the first wall; and wherein the metal reinforcing member of the second wall is disposed proximate an edge of the second wall.

25. The shed as in claim 23, wherein the metal reinforcing member of the first wall is a thin strip of metal that extends from a first end of the wall to a second end of the wall; and wherein the metal reinforcing member of the second wall is a thin strip of metal that extends from a first end of the wall to a second end of the wall.

26. The shed as in claim 23, wherein the metal reinforcing member of the first wall is a thin strip of metal with a first edge that contacts an inner portion of the first outer surface and a second edge that contacts an inner portion of the second outer surface; and wherein the metal reinforcing member of the second wall is a thin strip of metal with a first edge that contacts an inner portion of the first outer surface and a second edge that contacts an inner portion of the second outer surface.

27. The shed as in claim 23, wherein the metal reinforcing member of the first wall is a thin strip of metal that extends at least a majority of the length of the first wall; and wherein the metal reinforcing member of the second wall is a thin strip of metal that extends at least a majority of the length of the second wall.

28. The shed as in claim 23, wherein the metal reinforcing member of the first wall is a thin strip of metal that extends at least substantially the entire length of the first wall; and wherein the metal reinforcing member of the second wall is a thin strip of metal that extends at least substantially the entire length of the second wall.

29. A panel constructed from blow-molded plastic, the panel including a height, a width and a thickness, the panel comprising:

a first outer surface;

a second outer surface;

a hollow interior portion at least partially disposed between the first outer surface and the second outer surface, the first outer surface, the second outer surface and the hollow interior portion being integrally formed during the blow-molding process as part of a unitary, one-piece structure; and a metal reinforcing member at least substantially disposed within the hollow interior portion, the metal reinforcing member being sized and configured to increase the strength of the panel, the metal reinforcing member comprising:

a first portion that contacts an inner portion of the first outer surface; and a second portion that contacts an inner portion of the second outer surface.

30. The panel as in claim 29, further comprising a second reinforcing member at least substantially disposed within the panel.

31. The panel as in claim 29, wherein the first portion of the metal reinforcing member contacts an inner surface of a first outer wall of the panel and the second portion of the metal reinforcing member contacts an inner surface of a second outer wall of the panel.

32. The panel as in claim 29, wherein the first portion of the metal reinforcing member contacts an inner surface of an outer wall of the panel and the second portion of the metal reinforcing member contacts an inner surface of a side wall of the panel.

33. The panel as in claim 29, wherein the first portion of the metal reinforcing member contacts an inner surface of an outer wall of the panel and an inner surface of a side wall of the panel; and wherein the second portion of the metal reinforcing member contacts an inner surface of a side wall of the panel.

34. The panel as in claim 29, wherein the first portion of the metal reinforcing member contacts an inner surface of a first outer wall of the panel, the second portion of the metal reinforcing member contacts an inner surface of a side wall of the panel, and a third portion of the metal reinforcing member contacts an inner surface of a second outer wall of the panel.

35. The panel as in claim 29, wherein the metal reinforcing member is a thin strip of metal that is disposed at an angle relative to the first outer surface and the second outer surface of the panel.

36. The panel as in claim 29, further comprising a second panel, the second panel comprising:

a first outer surface;

a second outer surface;

a hollow interior portion at least partially disposed between the first outer surface and the second outer surface, the first outer surface, the second outer surface and the hollow interior portion being integrally formed during the blow-molding process as part of a unitary, one-piece structure; and a metal reinforcing member at least substantially disposed within the hollow interior portion, the metal reinforcing member being sized and configured to increase the strength of the panel, the metal reinforcing member comprising:

a first portion that contacts an inner portion of the first outer surface; and a second portion that contacts an inner portion of the second outer surface;

wherein the first panel and the second panel are connected together to form at least a portion of a wall.

37. The panel as in claim 29, further comprising a second panel, the second panel comprising:

a first outer surface;

a second outer surface;

a hollow interior portion at least partially disposed between the first outer surface and the second outer surface, the first outer surface, the second outer surface and the hollow interior portion being integrally formed during the blow-molding process as part of a unitary, one-piece structure; and a metal reinforcing member at least substantially disposed within the hollow interior portion, the metal reinforcing member being sized and configured to increase the strength of the panel, the metal reinforcing member comprising:

a first portion that contacts an inner portion of the first outer surface; and a second portion that contacts an inner portion of the second outer surface;

wherein the first panel and the second panel are used to form at least a portion of an enclosure.

38. A method of constructing a portion of an enclosure, the method comprising:

forming an outer wall from blow-molded plastic, the outer wall including a height, a width and a thickness, the outer wall including an inner surface, an outer surface and a hollow interior portion that is at least partially disposed between the inner surface and the outer surface, the inner surface, the outer surface and the hollow interior portion being integrally formed as part of a unitary, one-piece structure; and disposing a metal reinforcing member at least substantially within the hollow interior portion of the outer wall, the metal reinforcing member being sized and configured to increase the strength of the outer wall, the metal reinforcing member comprising:

a first portion that contacts an inner portion of the inner surface of the outer wall; and a second portion that contacts an inner portion of the outer surface of the outer wall.

39. The method as in claim 38, further comprising a second portion of the enclosure, the second portion comprising:

forming a second outer wall from blow-molded plastic, the second outer wall including a height, a width and a thickness, the second outer wall including an inner surface, an outer surface and a hollow interior portion that is at least partially disposed between the inner surface and the outer surface, the inner surface, the outer surface and the hollow interior portion being integrally formed as part of a unitary, one-piece structure; and disposing a metal reinforcing member at least substantially within the hollow interior portion of the second outer wall, the metal reinforcing member being sized and configured to increase the strength of the second outer wall, the metal reinforcing member comprising;

a first portion that contacts an inner portion of the inner surface of the second outer wall; and a second portion that contacts an inner portion of the outer surface of the second outer wall wherein the first outer wall and the second outer wall are used to form at least a portion of the enclosure.

40. The method as in claim 38, wherein the metal reinforcing member is integrally formed with the outer wall as part of a unitary, one-piece structure.

* * * * *

UNITED STATES PATENT AND TRADEMARK OFFICE

CERTIFICATE OF CORRECTION

PATENT NO. : 7,654,060 B2
APPLICATION NO. : 11/742469
DATED : February 2, 2010
INVENTOR(S) : Steed et al.

It is certified that error appears in the above-identified patent and that said Letters Patent is hereby corrected as shown below:

Column 1
Line 32, change "petition" to --partition--

Column 2
Line 1, change "panels" to --panel--
Line 21, change "panels" to --panel--

Column 3
Line 28, change "assembly" to --assemble--

Column 4
Line 35, change "results" to --result--

Column 5
Line 11, change "partitions:" to --partition.--
Line 65, change "one or may" to --one or more--

Column 6
Lines 45-67, change all 7 instances of "FIG. 1" to --FIG. 1A--

Column 7
Line 3, change "FIG. 1" to --FIG. 1A--
Line 64, delete "by"

Column 8
Line 39, change "one" to --on one--

Column 9
Line 12, change "other" to --have other--
Line 23, change "manner" to --manners--
Line 27, change "include" to --of--

Signed and Sealed this

Thirteenth Day of July, 2010

David J. Kappos

David J. Kappos
*Director of the United States Patent and Trademark Office*

Column 11
Line 16, change “aligned” to --be aligned--
Line 36, delete “are”
Line 61, change “column” to --a column--
Line 64, change “column” to --a column--

Column 12
Line 6, change “a one” to --one--
Line 9, delete “a”
Line 29, change “According” to --Accordingly--

Column 13
Line 48, change “patterns;” to --patterns,--
Line 51, change “patterns;” to --patterns,--

Column 14
Line 50, delete the “,” after “as”

Column 16
Line 52, change “a one” to --one--

Column 17
Line 3, change “and” to --and/or--
Line 14, change “and” to --and/or--
Line 24, change “and” to --and/or--

Column 18
Line 7, change “have” to --have a--
Line 49, change “such” to --such as--
Line 61, change “such” to --such as--

Column 24
Line 39, insert a --;-- after “wall”